US007273578B1

(12) United States Patent
Slutsker et al.

(10) Patent No.: US 7,273,578 B1
(45) Date of Patent: Sep. 25, 2007

(54) METHOD AND APPARATUS FOR LOW-SPEED, HIGH-THROUGHPUT FIBER DRAWING USING COILED FIBER LOOPS

(76) Inventors: Leonid Slutsker, 9709 Squirrel Wood Run, Douglasville, GA (US) 30135; Viacheslav A. Marikhin, Tikaoretskii PR. 13, Apt. 98, St. Petersburg (RU) 194064; Lioubov Petrovna Miasnikova, UL. Tchaikovskogo 63, Apt. 11, St. Petersburg (RU) 191123

( * ) Notice: Subject to any disclaimer, the term of this patent is extended or adjusted under 35 U.S.C. 154(b) by 0 days.

(21) Appl. No.: 11/155,810

(22) Filed: Jun. 18, 2005

Related U.S. Application Data

(63) Continuation-in-part of application No. 09/978,346, filed on Oct. 16, 2001.

(51) Int. Cl.
*D02J 1/22* (2006.01)

(52) U.S. Cl. ..... 264/289.6; 28/240; 28/244; 28/245; 264/290.5; 264/345

(58) Field of Classification Search ..... 264/289.6, 264/290.5, 345; 19/159 R, 236, 238, 240, 19/242; 28/240, 241, 244, 245; 57/287, 57/310

See application file for complete search history.

(56) References Cited

U.S. PATENT DOCUMENTS 2,302,508 A 11/1942 Sordelli
2,372,627 A 3/1945 Goggin
2,788,542 A 4/1957 Swalm
3,426,553 A 2/1969 Erb
3,774,384 A 11/1973 Richter
3,978,192 A 8/1976 Sussman
4,414,756 A 11/1983 Simpson
4,891,872 A 1/1990 Sussman
4,967,457 A 11/1990 Beck
4,980,957 A 1/1991 Sussman
5,339,503 A 8/1994 Sussman
5,340,523 A 8/1994 Sussman
5,522,161 A 6/1996 Vetter
5,588,604 A 12/1996 Vetter

*Primary Examiner*—Leo B. Tentoni

(57) ABSTRACT

A method and apparatus for continuous drawing of fibers in the form of coiled fiber loops (e.g., polygonal or serpentine loops). The successive fiber loops are continuously laid on receiving ends of a plurality of conveyer-drawing members (CDM) [e.g., rotating threaded spindles (54) or circulating endless chains (80) and (108)] disposed about a central axis and diverged from this axis. Coiled fiber loops are conveyed along the central axis and simultaneously drawn by enlarging a circumference of the fiber loops by the CDM. The leading fiber loops are continuously taken off at delivery ends of the CDM and conveyed from the drawing apparatus at an outlet speed. Heat chambers (11) and (148) envelop at least the most part of CDM. The process can operate at low drawing speed and long drawing time typical for lab-scale experiments and equal or higher outlet speed and throughput typical for commercial drawing processes. The method can produce low-cost/high-strength/high-modulus/low-shrinkage commercial polymer fibers.

38 Claims, 20 Drawing Sheets

I-I

II-II

II–II

METHOD AND APPARATUS FOR LOW-SPEED, HIGH-THROUGHPUT FIBER DRAWING USING COILED FIBER LOOPS

CROSS-REFERENCE TO RELATED APPLICATION

This is a continuation-in-part of a prior-filed application (application Ser. No. 09/978,346, filing date—Oct. 16, 2001, status—abandoned).

BACKGROUND OF THE INVENTION

This invention relates to a method and apparatus for drawing fibers, yarns, or tapes formed from natural resin, synthetic resin, or combination of both. For the sake of convenience, in the description of this invention, which follows, the method and apparatus will be described in terms of drawing fibers. However, it is to be understood that the method and apparatus are equally usable for drawing any elongated body elements subject to such procedure. But for all that, the invented drawing method and apparatus will be described in terms of drawing of fibers in the form of coiled fiber loops. It is to be understood that the coiled fiber loops are a connected set of rings or twists into which the fiber can be wound.

In the production of most polymer fibers (e.g., nylon, polypropylene, and polyester fibers) a drawing stage is included subsequent to the spinning or extrusion stage. In the drawing stage the fiber is usually drawn by a drawing apparatus at elevated temperature to a length substantially exceeding (in some cases, several times) their original length. The fiber passes the drawing apparatus with a speed $V_{fiber}$ which increases from the beginning to the end of the drawing stage, speed $V_{fiber}$ being a linear speed along the fiber axis of fiber points in the drawing process (along the tangent to the fiber axis if the fiber drawing occurs on the curved surface, e.g., a curved hot plate or a roller). A fiber draw ratio λ, which is the extent of fiber drawing, is given by $$\lambda = V_{fiber2}/V_{fiber1}, \quad (1)$$

where $V_{fiber1}$ is fiber speed $V_{fiber}$ in the beginning of the fiber drawing stage, and $V_{fiber2}$ is fiber speed $V_{fiber}$ at the end of the fiber drawing stage.

The drawing of the fibers enables them to achieve the required molecular orientation and structure by virtue of which they attain the necessary strength and other desired physical characteristics. As an example, typical λ for commercial nylon fibers is about 6 to 1. Usually, the higher λ, the higher molecular orientation and fiber tensile properties (tenacity and Young modulus in particular).

In case of a continuous multi-stage drawing process, $V_{fiber2}$ is the fiber linear speed at the end of the last fiber drawing stage, and $V_{fiber1}$ is the fiber linear speed in the beginning of the first fiber drawing stage.

The drawing has generally been hitherto effected on a commercial scale by passing the fiber from one set of rotating rollers to another. Each set of receiving rollers rotates at a surface speed, which is greater than that of the preceding set of feed rollers.

In case of drawing the fiber by the rotating rollers we get $$V_{fiber1} = V_{surface1} = V_{inlet} \text{ and} \quad (2)$$

$$V_{fiber2} = V_{surface2} = V_{outlet}, \quad (3)$$

where $V_{surface1}$ is a linear surface speed of the feed rollers, $V_{surface2}$ is a linear surface speed of the receiving rollers, $V_{inlet}$ is a fiber inlet speed, which is a fiber linear speed along the fiber axis of feeding the fiber to the feed rollers, and $V_{outet}$ is a fiber outlet speed, which is a fiber linear speed along the fiber axis of conveying the drawn fiber from the drawing stage either to a next stage of the continuous fiber making process (drawing, heat setting, relaxation, bulking or texturing, twisting, finish application, etc.) or to a receiving package.

Thus in conventional industrial drawing processes a ratio of fiber outlet speed $V_{outlet}$ to fiber speed $V_{fiber2}$ is 1 to 1 (this ratio will be used for discussion below).

In case of conveying drawn fiber after the drawing stage to the receiving package we get $$V_{fiber2} = V_{outlet} = V_{take\text{-}up}, \quad (4)$$

where $V_{take\text{-}up}$ is a take-up speed, which is a fiber linear speed along the fiber axis of taking up the drawn fiber on the receiving package (in some cases, $V_{take\text{-}up}$ is slightly higher than $V_{fiber2}$ and $V_{outlet}$ to provide some tension in the taken-up fiber).

Outlet speed $V_{outlet}$ and take-up speed $V_{take\text{-}up}$ determine the throughput of the drawing stage. Most conventional commercial processes, particularly in the area of melt-spun flexible-chain polymer fibers, have very high speed $V_{take\text{-}up}$ ranging from several hundred to several thousand meters per minute to provide high throughput. This means that in the high-throughput commercial processes speeds $V_{fiber2}$, and $V_{outlet}$ are also high, i.e., ranging from several hundred to several thousand meters per minute.

Another parameter is used to characterize the fiber drawing process, i.e., a speed of drawing or a strain rate $V_{strain}$, which is a relative deformation of the fiber (strain) in a unit time. Usually strain rate $V_{strain}$ is expressed in percent per second (%/sec) and is given by $$V_{strain} = \lambda/T, \quad (5)$$

where

T is time of drawing.

In conventional commercial processes strain rate $V_{strain}$ is high, i.e., several hundred percent per second.

In such conventional high-fiber-speed, high-drawing-speed processes the fiber is subjected to a very abrupt acceleration and rise in tension at the point where it leaves one roller to pass to the succeeding higher-speed roller. Care must be taken to ensure that the abrupt rise in tension does not break the fiber. Thus, this conventional technique may be termed "impulsive drawing" because the fiber experiences a sudden "impulsive" acceleration from its initial state to its final drawn state while traveling through the drawing machine. The "impulsive" acceleration and high tension result in frequent fiber breaks and equipment stops, high volume of waste, and preventing further fiber improvement.

Because of high fiber speed, time of drawing T is very short in most high-throughput industrial processes, i.e., less than a second for one-stage drawing and about 1-3 seconds for two- or three-stage drawing. This results in "non-equilibrium" drawing where the fiber does not have enough time to be heated to ambient elevated temperature while being drawn, and the drawing occurs at high temperature gradient in the fiber cross-section. This, in turn, results in reduced drawability and crystallinity, high gradient of morphology and physical properties in the cross-section, high local overstresses, reduced tensile properties, and dimensionally unstable fibers with high hot-air shrinkage. This is especially typical for fibers and yarns having high denier (denier is weight in grams of 9000 meters of fiber). To provide additional time for heat setting, the existing technology requires a separate, specialized, very expensive, and energy-consuming equipment to produce dimensionally stable fibers without decrease of their tensile properties (U.S. Pat. No. 5,522,161 to Vetter (1996), U.S. Pat. No. 5,588,604 to Vetter et al. (1996)—these patents are discussed below). More often, a different method for decreasing shrinkage is used in commercial processes. The fiber is subjected to restricted shrinkage while moving through a special stage, which follows the last drawing stage. In doing so, the initial modulus, intermediate moduli, and tenacity are reduced.

The commercial drawing processes mentioned above do not enable one to produce polymer fibers with tensile and other physical properties close to those made by lab-scale low-fiber-speed, low-drawing-speed, long-drawing-time, and non-impulsive drawing process. This lab-scale drawing may be termed "uniform" or "equilibrium" drawing, where drawing time T is long enough to heat the fiber to the ambient temperature, while it being drawn, with low temperature gradient in the fiber cross-section. This results in uniform morphology and physical properties in the cross-section. These lab-scale experiments achieve more effective morphological transition "low-oriented-high-oriented polymer system" and superior physical properties. For example, tenacity of lab-scale flexible-chain, regular-molecular-weight, melt-spun polymer samples is higher by a factor of about 1.5-2 and initial moduli are several times higher than those for conventional commercial fibers. (As an example, tensile properties of lab-scale polypropylene fibers can be seen in "Superdrawn Filaments of Polypropylene" by W. N. Taylor, J R. and E. S. Clark, Polym. Eng. Sci., 18, 518-526 (1978). A comparison of these results with tensile properties of commercial polypropylene fibers is presented in Table VI below). In order to overcome this large gap between the properties of lab-scale and commercial-scale polymer fibers, a new approach needs to be developed.

Moreover, within today's fiber industry there is another large gap, i.e., tensile properties of low-cost, low-performance, regular-molecular-weight, melt-spun, flexible-chain polymer fibers (e.g., polyethylene, polypropylene, polyester, nylon, etc.) are much lower than those of high-cost, high-performance, wholly-aromatic polymer fibers (e.g., Kevlar® 49, DuPont and Twaron®, Teijin) and ultra-high-molecular-weight, solution-spun, aliphatic polymer fibers (e.g., Spectra®, Honeywell and Dyneema®, DSM). The great challenge for fiber science and technology is to fill this gap by producing industrially a new generation of low-cost, high-performance polymer fibers (most probably, flexible-chain, regular-molecular-weight, melt-spun) with substantially improved tensile and other physical properties. This can be done by introducing the results of the lab-scale research efforts (mentioned above) to the industry. It would be extremely attractive to achieve in the high-throughput industrial process (i.e., with take-up speed $V_{take\text{-}up}$ ranging from several hundred to several thousand meters per minute) fiber tenacity of about 1-2 GPa (12-22 gpd) and initial tensile modulus of about 20-100 GPa (250-1000 gpd) for different flexible-chain, regular-molecular-weight polymer fibers having different theoretical values of tensile properties.

In the work of Taylor and Clark mentioned above, tenacity about 1 GPa (12 gpd) and initial modulus 22 GPa (270 gpd) where achieved for melt-spun, regular-molecular-weight polypropylene filaments in the lab-scale experiments (see Table VI below).

Any company that makes progress in this area will have a tremendous advantage in competition today and in the future. To the best of our knowledge, no significant progress in this area has been so far achieved by the American, Asian, or European fiber industries.

A few attempts have been made in the prior art to improve conventional industrial drawing methods.

A method and apparatus for incremental drawing of fibers on the industrial scale were introduced in U.S. Pat. No. 2,372,627 to Goggin et al. (1945), in U.S. Pat. No. 2,788,542 to Swalm et al. (1957) and in U.S. Pat. Nos. 3,978,192 (1976), U.S. Pat. No. 4,891,872 (1990), U.S. Pat. No. 4,980,957 (1991), U.S. Pat. No. 5,339,503 (1994), and U.S. Pat. No. 5,340,523 (1994), all to Sussman. The incremental drawing improves the conventional commercial drawing process by dividing it into small steps, typically 10-30, i.e., fibers are drawn on microterraced or smooth surfaces of a pair of conical rollers with canted axes.

U.S. Pat. No. 4,967,457 to Beck et al. (1990) disclosed an arrangement for stretching thermoplastic fibers. In this patent fiber moves through a plurality of non-driven rollers arranged between the delivery mechanism and the stretching mechanism inside the heat chamber. Some rollers have brakes providing several successive stretching zones.

Both invented methods provide longer drawing path and drawing time T as well as lower strain rate $V_{strain}$ in comparison with conventional methods. However, as in the conventional drawing methods the fiber, while being drawn, passes the drawing apparatuses at high speed and at the end of the drawing stage $V_{fiber2}=V_{outlet}$ (in other words, the ratio of outlet speed $V_{outlet}$ to fiber speed $V_{fiber2}$ is 1 to 1). If after the drawing stage the drawn fiber is conveyed to the receiving package, $V_{fiber2}=V_{outlet}=V_{take\text{-}up}$. Economical reasons force to keep speeds $V_{fiber2}$, $V_{outlet}$, and $V_{take\text{-}up}$ as high as possible, i.e., in the range from several hundred to several thousand m/min, in order to provide high throughput.

For both methods the "impulsive" acceleration, although reduced, remains high at each drawing step or zone. In case of high-throughput processes, the drawing is "non-equilibrium", i.e., it still has short drawing time (a few seconds), which is not enough to heat the fiber (especially high-denier fiber) to the ambient temperature in the process of drawing. In case of the incremental drawing, the fiber is drawn only between rollers and not on their surfaces while traveling through the drawing apparatus. This results in reduction of drawing time to the level, which can reach about half of the residence time in the apparatus. The drawing starts and stops while the fiber moves through the drawing apparatus. Thus, the incremental drawing is not uniform and may be termed "intermittent drawing".

A technology for winding fiber into coiled loops around a conveyer device, conveying these fiber loops at a slow speed and high residence time through a heat chamber by this conveyer device, then unwinding these fiber loops, and taking up the fiber with high speed has been proposed for fiber heat setting in U.S. Pat. No. 3,426,553 to Erb (1969), U.S. Pat. No. 3,774,384 to Richter (1973), U.S. Pat. No. 4,414,756 to Simpson et al. (1983), U.S. Pat. No. 5,522,161 to Vetter (1996), and U.S. Pat. No. 5,588,604 to Vetter et al.

(1996). However, the invented method and apparatuses were not designed for and capable of fiber drawing.

U.S. Pat. No. 2,302,508 to Sordelli (1942) disclosed an apparatus substantially in the form of a winding frame having the general form of a frustum of a cone, which upon being set rotating about its axis promotes the winding of the filament material in a series of helical turns distributed over the apparatus from its end having the minimum diameter towards the opposite end having the maximum diameter. The filament material winds up in a continuous manner onto the apparatus and unwinds therefrom after it has traveled along the said series of turns; during the movement the material undergoes a continuous progressive stretching action, whereby it increases in length to an extent which depends upon the structural characteristics of the apparatus. The winding frame comprises a carrier member rotating about a central axis and a plurality of cantilever rollers each rotatably mounted at one end at said carrier member, the axes of said rollers being both diverged and skewed with respect to the central axis. The skewed rotated rollers draw the fiber by expanding the helical turns while conveying these turns along the central axis.

In this invention, the fiber passes the drawing apparatus at low speed providing longer drawing path and drawing time T as well as lower strain rate $V_{strain}$ in comparison with conventional industrial drawing processes. However, this apparatus has some disadvantages with respect to implementation on the industrial scale. They are as follows:

(1) It is complicated in design having the diverged and skewed cantilever conveyer-drawing members (driven rollers) rotated about their exes and simultaneously about the central axis as a part of the winding rotating frame.

(2) The apparatus has a fixed angle of divergency of the conveyer-drawing members and is not capable to change the fiber draw ratio, if it is necessary, by changing the angle of divergency.

(3) The conveyer-drawing members (which are cantilever, diverged, and skewed with respect to the central axis) are not strong enough to sustain high drawing forces in the drawing process while drawing large number of the fiber loops (up to a few hundreds) especially in case of high draw ratios (e.g., 5× and higher), high denier filaments, and present-day high tenacity fibers. Large number of loops (100-200 and higher) is necessary to provide long drawing time T and low strain rate $V_{strain}$ at high outlet speed $V_{outlet}$ and throughput [see equation (32) below ]. For the same reasons, Sordelli's apparatus has also limitations to be long to place large number of the loops. Sordelli's apparatus has also limitations to provide large angle of divergency of the conveyer-drawing members and large diameter (and circumference) of the leading fiber loop at the delivery ends necessary for high draw ratios (5× and higher) because of design of the driving mechanism (gear box) to drive the conveyer-drawing members and possibility of sliding down of the fiber loops along the conveyer-drawing members (see below).

(4) In Sordelli's apparatus, the conveyer-drawing members (rollers) have smooth surface covered with rubber or other materials to improve friction and to prevent sliding down of the fiber loops on the surface of the members. In that case, it would be difficult to find the coating that can operate inside a heat chamber at elevated temperatures necessary for effective hot drawing of the fibers. Without the coating, it is quite possible that the loops will slide down the conveyer-drawing members especially in case of (i) the higher divergency of the conveyer-drawing members necessary for higher draw ratios, (ii) some polymers with lower friction coefficient, and (iii) some finishes applied in the fiber making process.

(5) Sordelli's apparatus is not operator-friendly, i.e., it is difficult to load the fiber end into the apparatus to start the drawing process as well as to restart the apparatus after fiber breakage, and, in case of fiber breakage, the broken ends can be easily wound on the rotated conveyer-drawing members (rollers) resulting in significant operational problem.

Thus, the Sordelli's apparatus has substantial disadvantages to be industrially feasible.

BRIEF SUMMARY OF THE INVENTION

This invention relates to a method and apparatus for low-fiber-speed, low-drawing-speed, high-throughput, uniform, continuous drawing of fibers, or like flexible elements formed from natural resins, synthetic resins, or combination of both, in the form of coiled fiber loops. As mentioned above, the coiled fiber loops are a connected set of rings or twists into which the fiber can be wound.

The fiber is fed at an inlet speed to the drawing apparatus, which comprises a conveyer-drawing structure comprising a plurality of conveyer-drawing members (e.g., rotating threaded spindles or circulating endless chains) disposed about a central axis. The conveyer-drawing members have receiving ends and delivery ends spaced along the central axis and diverge from this axis in such a way that the distance between the delivery ends and the central axis is greater than the distance between the receiving ends and the central axis. The coiled fiber loops are continuously laid on the receiving ends of the moving conveyer-drawing members. The conveyer-drawing members draw the fiber by expanding the circumference of the fiber loops while slowly conveying these loops along the central axis from the receiving ends to the delivery ends. Thus, a layer consisting of coiled fiber loops (e.g., circular or serpentine loops) is formed on the conveyer-drawing members. Preferably, the points of the fiber loops are moved along the fiber axis (e.g., the fiber circular loops are slowly rotated about the central axis) preventing the fiber loops from having permanent contact points with the conveyer-drawing members.

The coiled fiber loops, while being conveyed and drawn, are subjected to elevated temperature using a heat chamber supplied with hot air, hot inert gas, or superheated steam.

At the delivery ends, leading loops of the drawn fiber are successively removed. The fiber is conveyed either to a next stage of the fiber making process or to a receiving package at outlet speed $V_{outlet}$ ranging from several hundred to several thousand meters per minute.

In comparison with existing industrial processes, the invented drawing process has one or more of following advantages: significantly longer drawing time T, lower strain rate $V_{stain}$, and lower tension in the drawing line at the same or higher fiber speeds $V_{outlet}$ and $V_{take\text{-}up}$ and throughput. This opens the door for substantial improvement of physical properties of commercial fibers, less breaks, less equipment stops, and less waste in comparison with the prior art in industrial fiber technology.

OBJECTS OF THE INVENTION

It is an object of the present invention to provide a new method and apparatus for continuous drawing of polymer fibers that avoid the disadvantages of the prior art.

1. It is an object of the present invention to provide a new industrial method and apparatus for continuous fiber drawing which meet two requirements that are considered incompatible by the fiber industry, in particular in the area of melt-spun flexible-chain polymer fibers:

(a) requirement of the fiber industry—to have high outlet speed $V_{outlet}$ and take-up speed $V_{take\text{-}up}$ ranging from several hundred to several thousand meters per minute to provide high throughput, and (b) requirement of the polymer fiber science—to provide long drawing time T and low strain rate $V_{strain}$ which are necessary to achieve the efficient "low oriented-high oriented polymer system transition" and to produce high-performance fibers. Drawing time T needs to be long enough (i.e., ranging from several seconds to several tens of seconds) to heat the fiber in the drawing process to the ambient elevated temperature with low temperature gradient and uniform morphology and physical properties in the fiber cross-section. Strain rate $V_{strain}$ needs to be at least one to two orders of magnitude lower than that in the industrial processes (i.e., ranging from several %/sec to several tens of %/sec).

2. Another object of the present invention is to provide a new industrial method and apparatus for continuous drawing of polymer fibers (both flexible-chain and wholly-aromatic) capable of substantially improving fiber tensile properties (i.e., tenacity, Young modulus, intermediate moduli, breaking elongation, etc.) approaching those obtained in laboratory experiments at low strain rate $V_{strain}$ and long drawing time T. In particular, this will result in development of a new generation of low-cost, high-performance industrial polymer fibers (most probably melt-spun, regular-molecular-weight, flexible-chain) having tenacity of about 1-2 GPa (12-22 gpd) and initial tensile modulus of about 20-100 GPa (250-1000 gpd) for different polymer fibers having different theoretical values of tensile properties.

3. Another object of the present invention is to provide a more reliable industrial process for continuous fiber drawing without abrupt, "impulsive" acceleration. This process will result in lower tension in the drawing line, less breaks, less equipment stops, and less waste than in the prior art.

4. An additional object of the present invention is to provide a new industrial method and apparatus for continuous fiber drawing which will produce dimensionally stable, low-shrinkage fibers without using expensive and energy-consuming additional equipment, while retaining improved physical properties, such as initial modulus, intermediate moduli, and tenacity, mentioned above. This may result in substantial saving in capital expenses, energy consumption, and possibility of smaller industrial space.

5. A further object of the present invention is to develop a new industrial method and apparatus for continuous fiber drawing (a) providing, in some cases, a substantial increase in the throughput in comparison with the existing industrial processes by increasing outlet speed $V_{outlet}$ and take-up speed $V_{take\text{-}up}$ and (b) maintaining existing or improved physical properties, such as initial modulus, intermediate moduli, tenacity, and shrinkage, mentioned above.

6. To accomplish the objects mentioned above, it is an object of the present invention to develop a new industrial method and apparatus for continuous fiber drawing which provide a ratio of outlet speed $V_{outlet}$ to a fiber speed $(V_{fiber})_{max}$ greater than 1 to 1 (i.e., preferably in the range from about 10 to 1 to about 9000 to 1), fiber speed $(V_{fiber})_{max}$ being the highest value of fiber speed $V_{fiber}$ in the drawing process. In the prior art discussed above, fiber speed $(V_{fiber})_{max}$ is fiber speed at the end of the drawing stage $V_{fiber2}$ which equals $V_{outlet}$. Thus, in the prior art the ratio of $V_{outlet}$ to $(V_{fiber})_{max}$ is 1 to 1.

Still further objects and advantages will become apparent from the consideration of the ensuing description and drawings.

BRIEF DESCRIPTION OF THE DRAWINGS

In the drawings, closely related figures have the same number but different alphabetic suffixes.

Figure 1A:
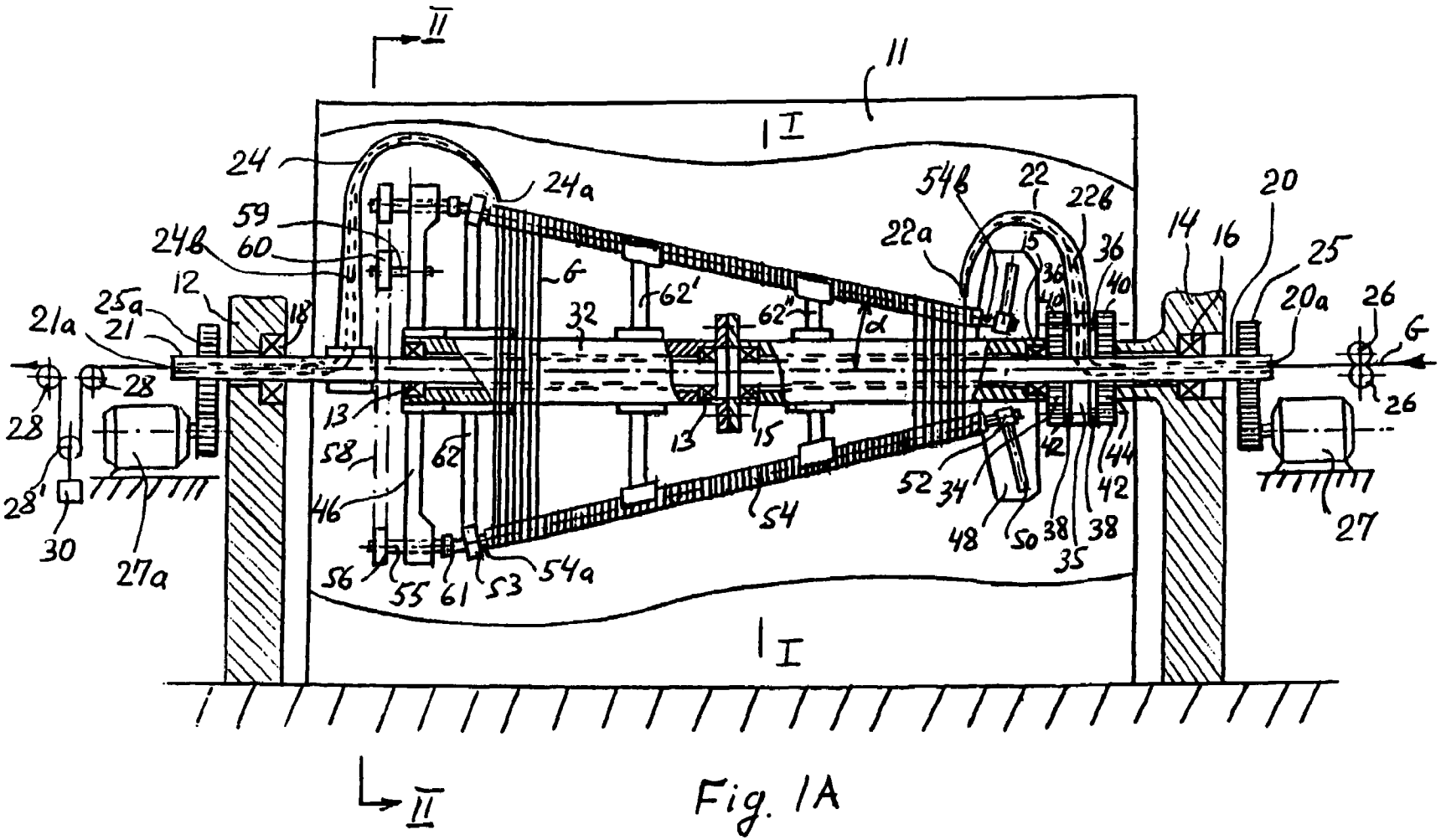
FIG. 1A is a longitudinal view illustrating one embodiment of the present invention where the conveyer-drawing members are rotating threaded spindles.

| REFERENCE NUMERALS IN DRAWINGS | |
|---|---|
| 11 | heat chamber |
| 12, 14 | supporting housings |
| 13, 15 | bearings |
| 16, 18 | supporting bearings |
| 20, 21 | drive shafts |
| 20a | first inner guide channel |
| 21a | third inner guide channel |
| 22 | fiber winding flyer |
| 22a | outlet (of the fiber winding flyer) |
| 22b | second inner guide channel |
| 24 | fiber unwinding flyer |
| 24a | inlet (of the fiber unwinding flyer) |
| 24b | fourth inner guide channel |
| 25, 25a | driving gears |
| G | fiber |
| 26 | feed roller |
| 27, 27a | electric motors |
| 28 | conveying roller |
| 28' | roller |
| 30 | weight |
| 32 | tubular support |
| 34 | first sun gear |
| 35 | planetary carrier |
| 36, 38 | shafts |
| 40, 42 | planetary pinions |
| 44 | second sun gear |
| 46, 48 | radial arms |
| 49 | radial arm |
| 50 | guide slot |
| 52, 53 | bearings |
| 54 | spindle |
| 54a, 54b | shaft portions |
| 55 | shaft |
| 56, 57 | chain wheels |
| 58, 58a | chains |
| 59 | shaft |
| 60 | chain wheel |
| 61 | universal joint |
| 62, 62', 62" | radial arms |
| 66, 66a, 66b | chain sections |
| 68 | chain wheel |
| 69 | shaft |
| 68' | double guide chain wheel |
| 70, 70', 70" | radial arms |
| 71, 71', 71", 71"' | radial arms |
| 72 | beveled gear |
| 74 | beveled gear |
| 76a, 76b | fiber displacing members |
| 77 | guide semi-ring |
| 78, 78', 78" | supporting parts |
| 80 | chain |
| 82 | shaft |
| 84, 86 | beveled gears |
| 88 | shaft |
| 90 | long gear |
| 92 | shaft |
| 96, 97 | supporting parts |
| 98 | roller |
| 98a | circumferential groove |
| 100 | gear |
| 102 | ball bearing |
| 104 | shaft |
| 106, 106a | pins |
| 108 | chain |

-continued

| REFERENCE NUMERALS IN DRAWINGS | |
|---|---|
| 110 | supporting housing |
| 112 | roller |
| 114 | chain |
| 116 | supporting part |
| 118 | chain wheel |
| 120 | roller |
| 122, 122' | feed and take-off rollers |
| 124, 126 | rollers |
| 124', 126' | rollers |
| 128, 128' | weights |
| 130, 130' | rollers |
| 132, 132' | feed and take-off flyers |
| 134, 134' | guides |
| 136, 136' | springs |
| 138, 138' | plungers |
| 140, 140', 142 | solenoids |
| 141, 141', 144 | cores |
| 146 | electric motor |
| 148 | heat chamber |
| 150 | chain wheel |
| 152 | shaft |
| 154 | ball bearing |
| 156 | spacer |
| 160 | chain wheel |
| 162 | circular groove |

DETAILED DESCRIPTION OF THE INVENTION

This invention is further illustrated by the following embodiments, which are not to be construed in any way as imposing limitations upon the scope thereof. On the contrary, it is to be clearly understood that resort may be had to various other embodiments, modifications, and equivalents thereof, which, after reading the description herein, may suggest themselves to those skilled in the art without departing from the spirit of the present invention and/or the scope of the appended claims.

Figure 1B:
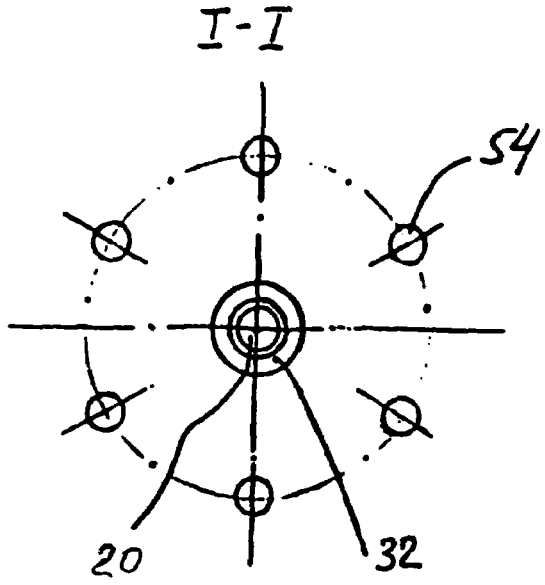
FIG. 1B shows, in schematic sectional view taken on line I-I in FIG. 1A, threaded spindles arranged in an equilateral hexagon.
Figure 1C:
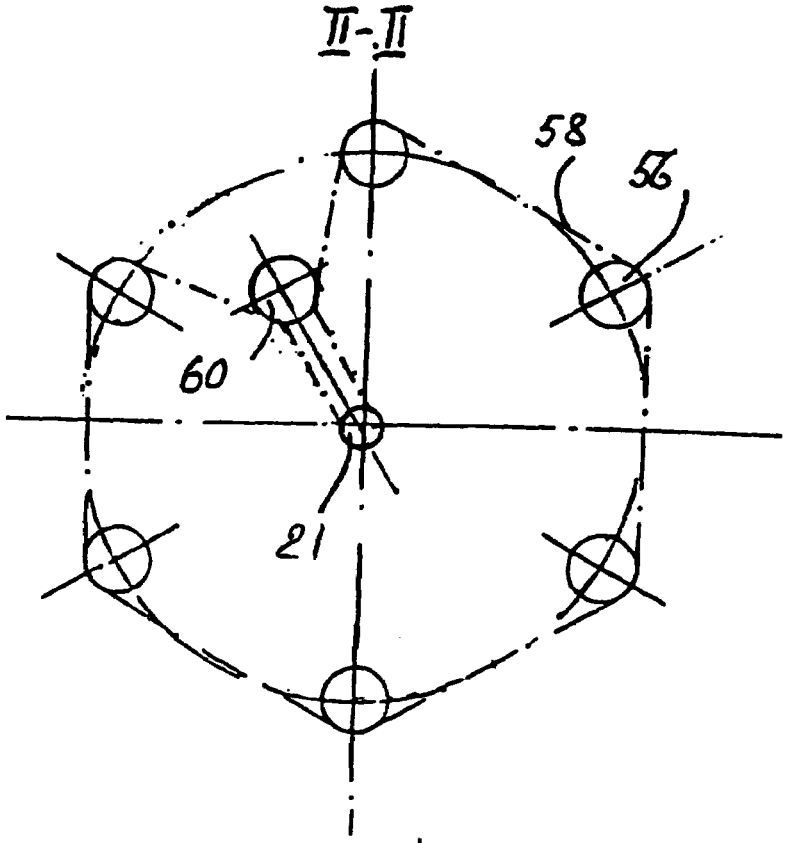
FIG. 1C shows, in schematic sectional view taken on line II-II in FIG. 1A, chain wheels for rotating threaded spindles arranged in an equilateral hexagon.

FIGS. 1A-1C—One Embodiment

One embodiment of the invention for continuous drawing of fibers in form of coiled fiber loops is illustrated in FIGS. 1A-1C. FIG. 1A shows a longitudinal view of an invented apparatus for the fiber drawing which has the following main parts: (a) a conveyer-drawing structure for conveying and simultaneous drawing a fiber G in the form of coiled fiber loops, (b) a feed device for feeding fiber G to the conveyer-drawing structure at an inlet speed and laying successive, coiled fiber loops around the conveyer-drawing structure at the beginning of the fiber drawing, (c) a take-off device for taking continuously off the leading fiber loops from the conveyer-drawing structure at the end of the fiber drawing and conveying the drawn fiber from the fiber drawing apparatus either to the next stage of the fiber making process or to the receiving package at an outlet speed, (d) a driving mechanism for driving parts of the conveyer-drawing structure, the feed device, and the take-off device, and (e) a heat chamber 11 for heating fiber G while the fiber being conveyed and drawn. For a detailed description see below.

(a) The conveyer-drawing structure comprises six spindles 54 comprising shaft portions 54*a* and 54*b* and a thread or a spiral groove. The spindles are disposed about a central axis and have receiving ends for receiving the fiber and delivery ends for delivering the fiber and both the receiving ends and the delivery ends are spaced along the central axis. The delivery ends are spaced further from the central axis than the receiving ends. Spindles 54 are arranged in an equilateral hexagon when viewed in the cross-section (FIG. 1B) and positioned at a changeable divergence angle α(the same for all spindles) to the central axis (FIG. 1A) that means that the spindles lie and diverge in plane with the central axis.

The conveyer-drawing structure comprises supporting housings 12 and 14, supporting bearings 16 and 18, bearings 13 and 15, bearings 52 and 53, drive shafts 20 and 21, a tubular support 32 (composed of two parts), and radial arms 46, 48, 62, 62', and 62" (six of each arm). The radial arms are arranged in an equilateral hexagon when viewed in the cross-section. Bearings 16 and 18, which are mounted in housings 14 and 12 respectively, support one end of shaft 20 and one end of shaft 21 respectively. Two bearings 13 and two bearings 15 are mounted in tubular support 32. They support shafts 21 and 20 respectively. Support 32 supports radial arms 46, 48, 62, 62', and 62". Arms 48 support bearings 52. Bearings 52 can be moved along and secured in guide slots 50 in arms 48, angle γ of spindles 54 being changed. Arms 62 support bearings 53. Bearings 53 and 52 support shaft portions 54*a* and 54*b* of spindles 54 respectively. Arms 62' and 62" support spindles 54 to prevent sagging.

The conveyer-drawing structure comprises a stabilizing mechanism which prevents rotation of the conveyer-drawing structure (to put it more precisely, its parts supported by tubular support 32) about the central axis. The stabilizing mechanism is located at the receiving ends of spindles 54. It comprises a planetary carrier 35, shafts 36 and 38, a pair of planetary pinions 40, a pair of planetary pinions 42, a first sun gear 34, and a second sun gear 44.

Planetary carrier 35 is secured to shaft 20, shafts 36 and 38 are mounted on carrier 35 for rotation, planetary pinions 40 are secured to shaft 36, planetary pinions 42 are secured to shaft 38, first sun gear 34 is secured to tubular support 32, and second sun gear 44 is secured to supporting housing 14.

(b) The feed device comprises a pair of driven feed rollers 26, a fiber-winding flyer 22, an outlet 22*a*, a first inner guide channel 20*a*, a second inner guide channel 22*b*, a polytetrafluoroethylene tube (not shown), carrier 35, and shaft 20 (carrier 35 and shaft 20 are also parts of the conveyer-drawing structure, see above). Flyer 22 is secured to carrier 35 at the receiving ends of spindles 54. Flyer 22 has outlet 22*a* at its free end and second guide channel 22*b* communicating with first guide channel 20*a* passing through the end portion of shaft 20 and planetary carrier 35. The polytetrafluoroethylene tube (not shown) is inserted into channels 20*a* and 22*b* up to outlet 22*a*, the fiber passing through the channels with very little friction.

(c) The take-off device comprises a pair of driven conveying rollers 28, a roller 28', a weight 30, an fiber-unwinding flyer 24, an inlet 24*a*, a third inner guide channel 21*a*, a fourth inner guide channel 24*b*, a polytetrafluoroethylene tube (not shown), and shaft 21 (it is also a part of the conveyer-drawing structure, see above). Flyer 24 is secured to shaft 21 at the delivery ends of spindles 54. Flyer 24 has inlet 24*a* at its free end and fourth guide channel 24*b* communicating with third guide channel 21*a* passing through the end portion of shaft 21. Roller 28' supports weight 30. The polytetrafluoroethylene tube (not shown) is inserted into channels 21*a* and 24*b* up to inlet 24*a*, the fiber passing through the channels with very little friction.

(d) The driving mechanism comprises electric motors 27 and 27*a*, driving gears 25 and 25*a*, shafts 20 and 21 (they are also parts of the conveyer-drawing structure, the feed device, and the take-off device, see above), six chain wheels 56, a chain wheel 60, a chain 58, universal joints 61, shafts 55, a shaft 59, and an adjustable transmission (not shown). Gear 25 is secured to shaft 20, and gear 25*a* is secured to shaft 21. Chain wheels 56 are secured to shafts 55 mounted in arms 46 for rotation. Chain wheel 60 is mounted on shaft 59 for rotation and connected by the adjustable transmission (not shown) to shaft 20 (FIG. 1C). Shaft 59 is secured to arm 46. Chain 58 passes over wheels 56 and wheel 60. Universal joints 61 are mounted on the other ends of shafts 55 and connected to shaft portions 54*a* of spindles 54 (FIGS. 1A and 1C).

(e) Heat chamber 11 envelops the conveyer-drawing structure (besides supporting housings 12 and 14 and bearings 16 and 18), the winding and unwinding flyers, and the driving mechanism besides motors 27 and 27*a* and gears 25 and 25*a*. It is supplied with hot air, hot inert gas, or superheated steam.

FIGS. 1A-1C—Operation

Electric motor 27 rotates gear 25 and hence rotates shaft 20 in bearing 16 and two bearings 15. Shaft 20 rotates carrier 35 with flyer 22, shafts 36 and 38, and pinions 40 and 42 about the central axis. Pinions 40 and 42 roll on sun gears 34 and 44 preventing support 32 from turning about shaft 20 and the central axis. Thus the parts of the conveyer-drawing structure supported by tubular support 32 are prevented from rotation about the central axis. Electric motor 27*a* rotates gear 25*a* and hence rotates shaft 21 in bearing 18 and two bearings 13. Shaft 21 rotates flyer 24 about the central axis.

Spindles 54 are rotated by means of electric motor 27*a*, gear 25*a*, shaft 21, the adjustable transmission (not shown), wheel 60, chain 58, wheels 56, shafts 55, and universal joints 61. Shaft portions 54*a* and 54*b* of spindles 54 rotate in bearings 53 and 52, respectively.

Fiber G comes to feed rollers 26 at an inlet speed either from a previous stage of the fiber making process (e.g., spinning, previous stage of drawing, etc.) or from a feeder package. The fiber passes through channels 20*a* and 22*b* and comes out of outlet 22*a*. Flyer 22 rotates with shaft 20 and carrier 35 and lays successive, coiled equilateral hexagonal fiber loops about the receiving ends of rotating spindles 54. Spindles 54 are rotated in such a direction that the newly laid fiber loops travel to the left along the central axis, as viewed in FIG. 1A, freeing room for the next laid fiber loop. A layer of the coiled fiber loops is formed around spindles 54. The spindle thread or spiral groove serves as a fiber displacing member providing the fiber loop conveying along the central axis and the fiber drawing.

Figure 6A:
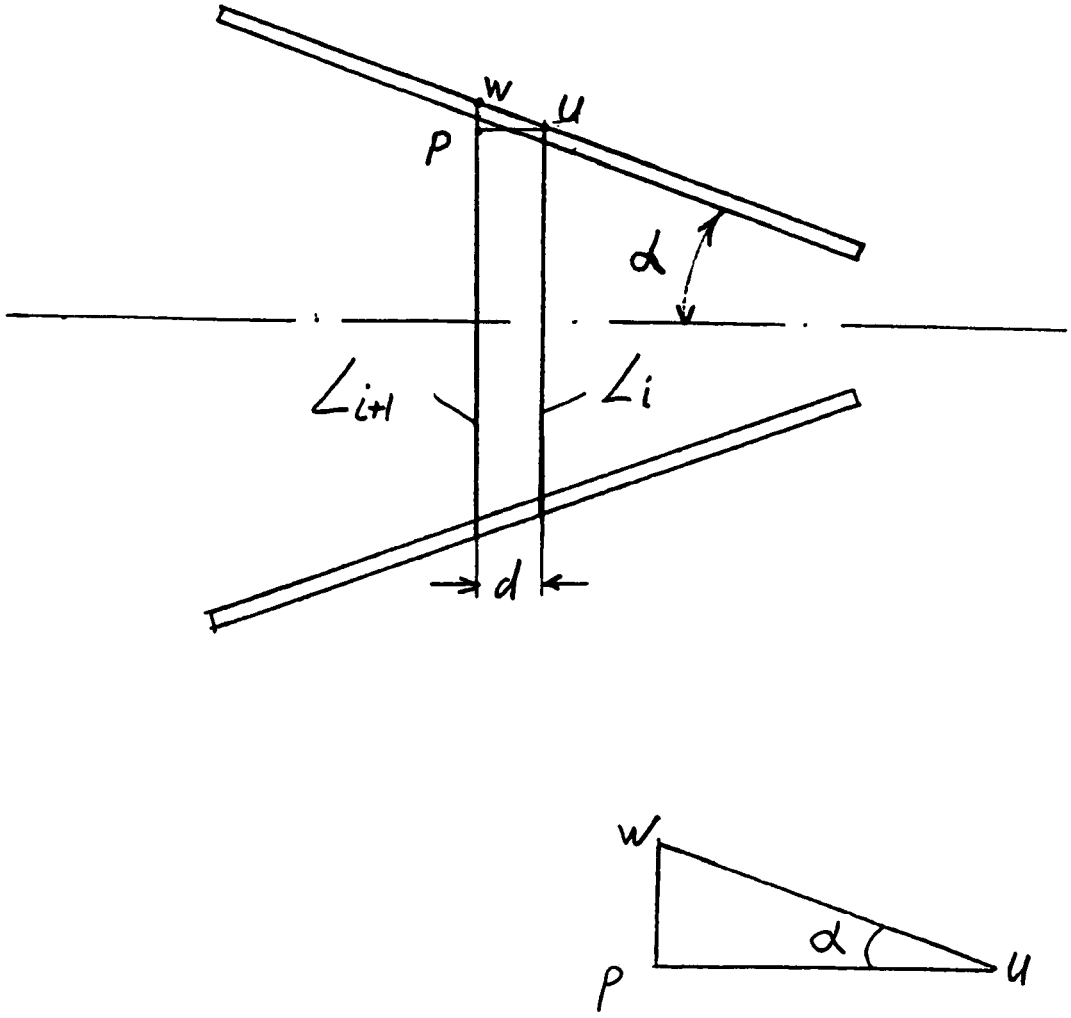
FIGS. 6A and 6B are schematic views of increase of fiber loop circumference from $L_i$ to $L_{i+1}$ while the loop passes distance d along the central axis that takes time ΔT.
Figure 6B:
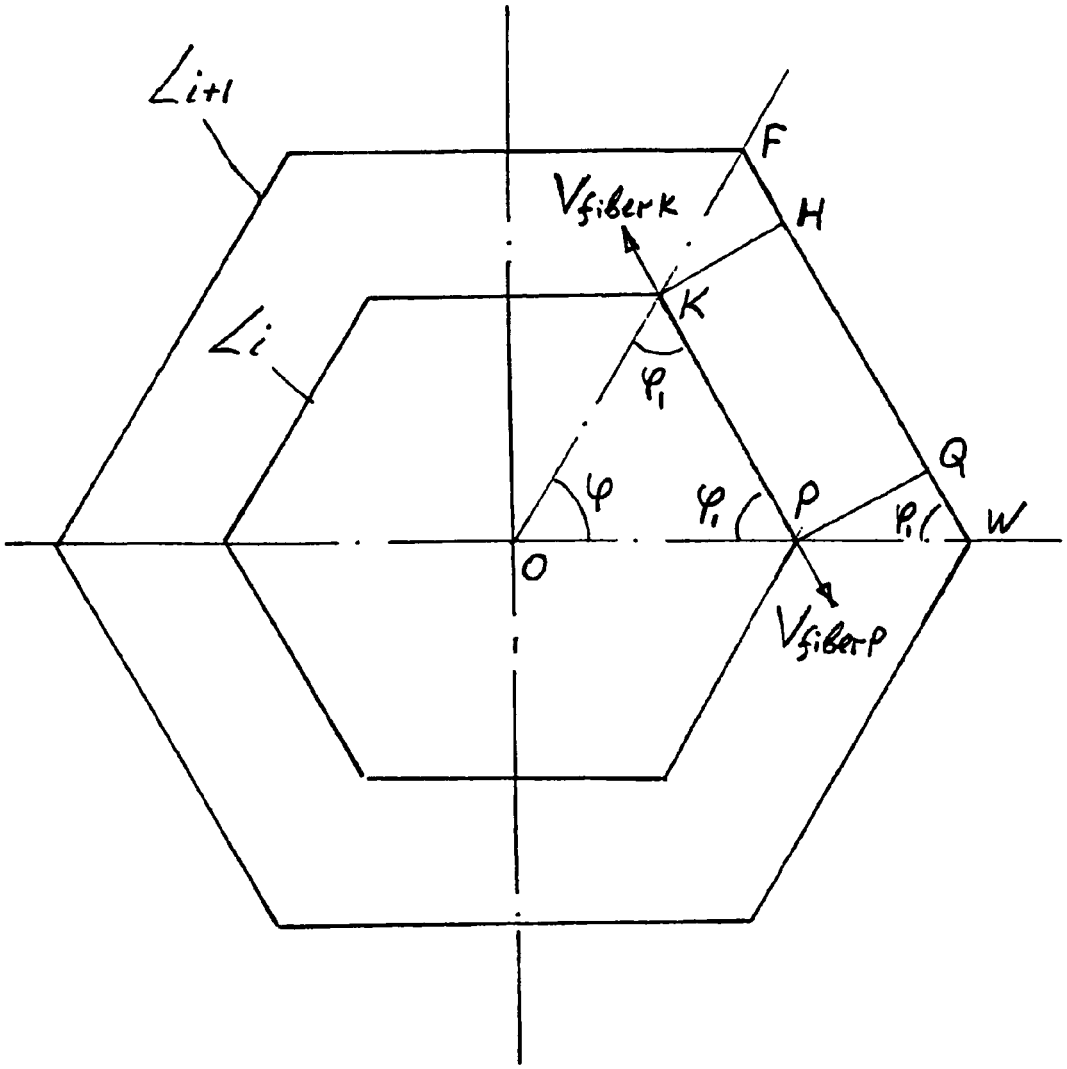

Both flyers 22 and 24 make one revolution while spindles 54 make one revolution. As this takes place, each fiber loop travels along the central axis one pitch of the fiber coil. Simultaneously the coiled fiber loops are slowly rotated about the central axis by the rotating spindles, and each point of the fiber loop passes along the loop circumference a distance equal to a spindle circumference (measured at inner diameter of the thread or spiral groove). The loops increase their circumference with each spindle revolution, the fiber gradually being drawn by rotating spindles 54 at the heat chamber temperature (FIGS. 6A and 6B). The leading fiber loops are continuously unwound by flyer 24 at the delivery ends of spindles 54. The corresponding length of the fiber is conveyed through inlet 24*a* and guide channels 24*b* and 21*a* by conveying rollers 28 and roller 28'. The fiber is conveyed either to the next stage of the fiber making process or, through a winder (not shown), to the receiving package (not shown). The fiber does not have permanent contact points with the spindles. This provides the uniformity of the dimensions and physical properties of the drawn fiber.

For the invented method and apparatus, the fiber draw ratio λ equals the ratio of the loop circumference at the delivery ends to that at the receiving ends. It can be changed by moving bearings 52 along guide slots 50 in arms 48 and securing them there, angle α of spindles 54 being changed. This results in changing the loop circumference at the receiving ends. Heights of arms 62' and 62" supporting spindles 54 are adjusted when angle α is changed. The fiber, while being fed to and taken off the spindles, is under tension and cannot shrink because feed rollers 26 and conveying rollers 28 with roller 28' and weight 30 carry out tension control along with additional tension control devices (not shown) placed before and after the whole apparatus.

FIGS. 2A-2D—Another Embodiment

Figure 2A:
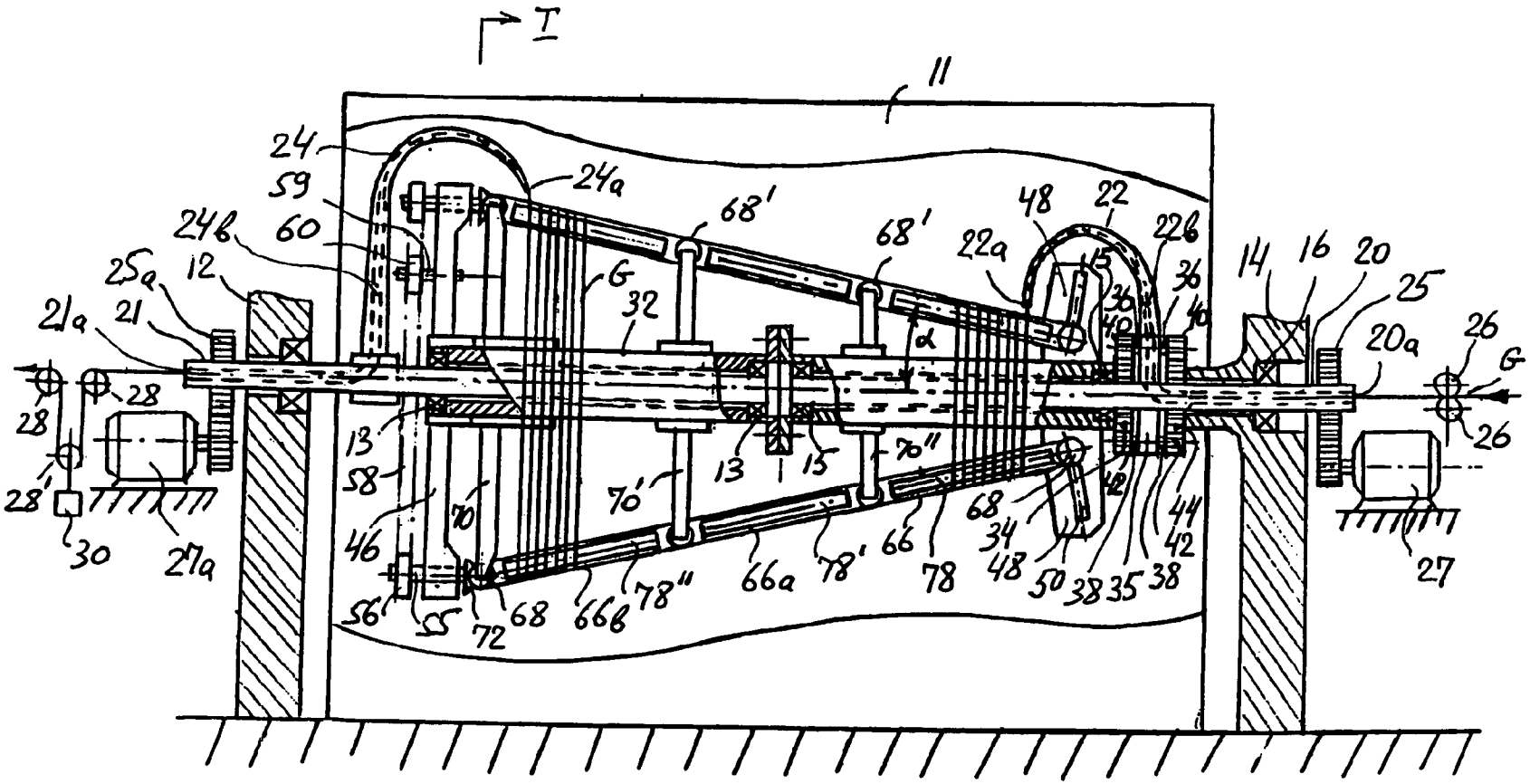
FIG. 2A is a longitudinal view illustrating another embodiment of the present invention where each conveyer-drawing member consists of several circulating endless chain sections.
Figure 2B:
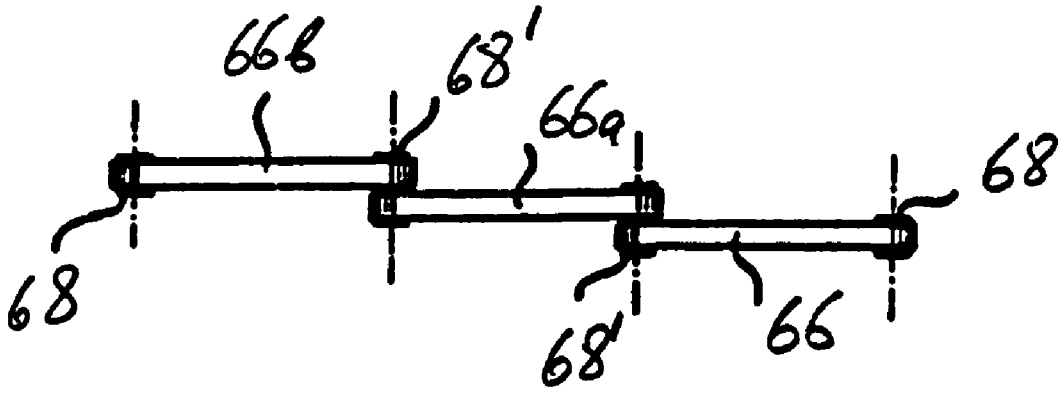
FIG. 2B is a fragmentary, schematic plan view illustrating the conveyer-drawing chain arrangement of the embodiment of FIG. 2A.

The embodiment illustrated in FIGS. 2A-2D corresponds to the embodiment of FIGS. 1A-1C and corresponding parts have the same reference numbers. In the conveyer-drawing structure spindles 54 (FIG. 1A) are replaced with the same number (six) of circulating chain members arranged in an equilateral hexagon when viewed in the cross-section. Each chain member is subdivided into three separate endless circulating chain sections 66, 66*a*, and 66*b*, which pass over chain wheels 68 and double guide chain wheels 68' (FIGS. 2A and 2B).

Figure 2C:
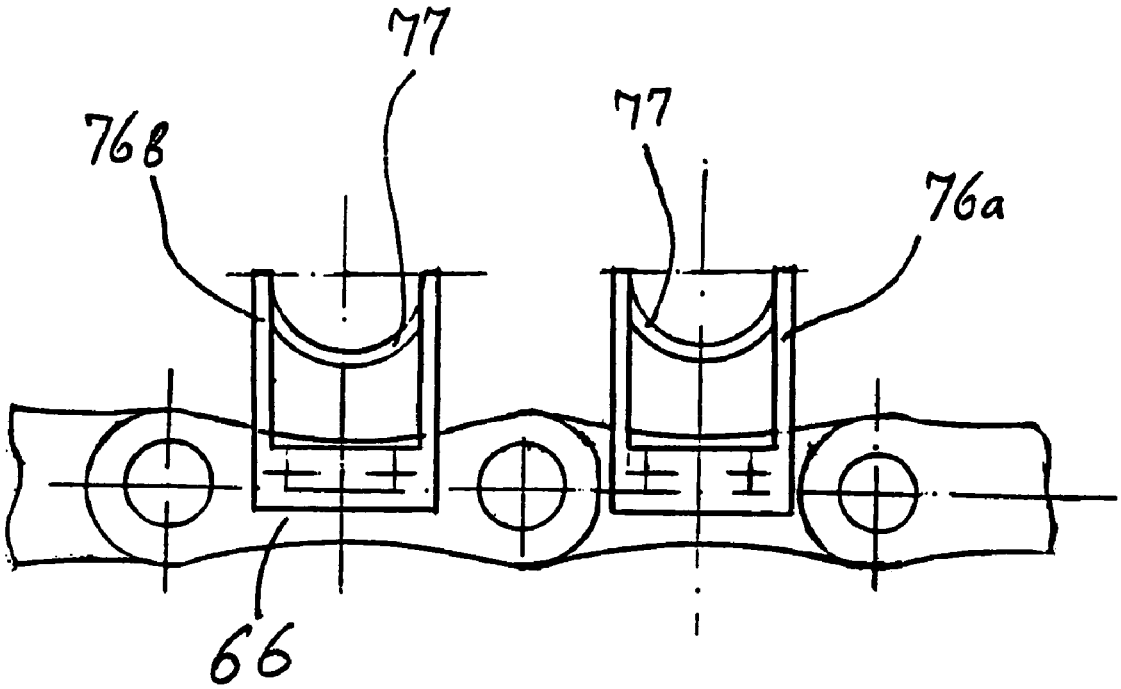
FIG. 2C is a fragmentary schematic views of the conveyer-drawing chains in FIG. 2A having fiber displacing members comprising guide semi-rings for controlling the fiber loop positioning.
Figure 2C:
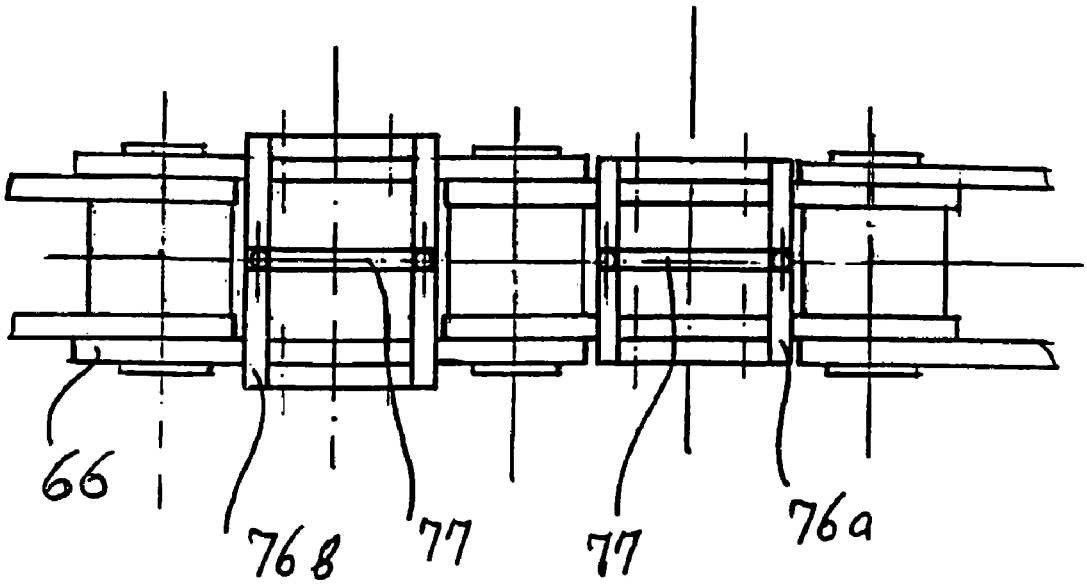
Figure 2D:
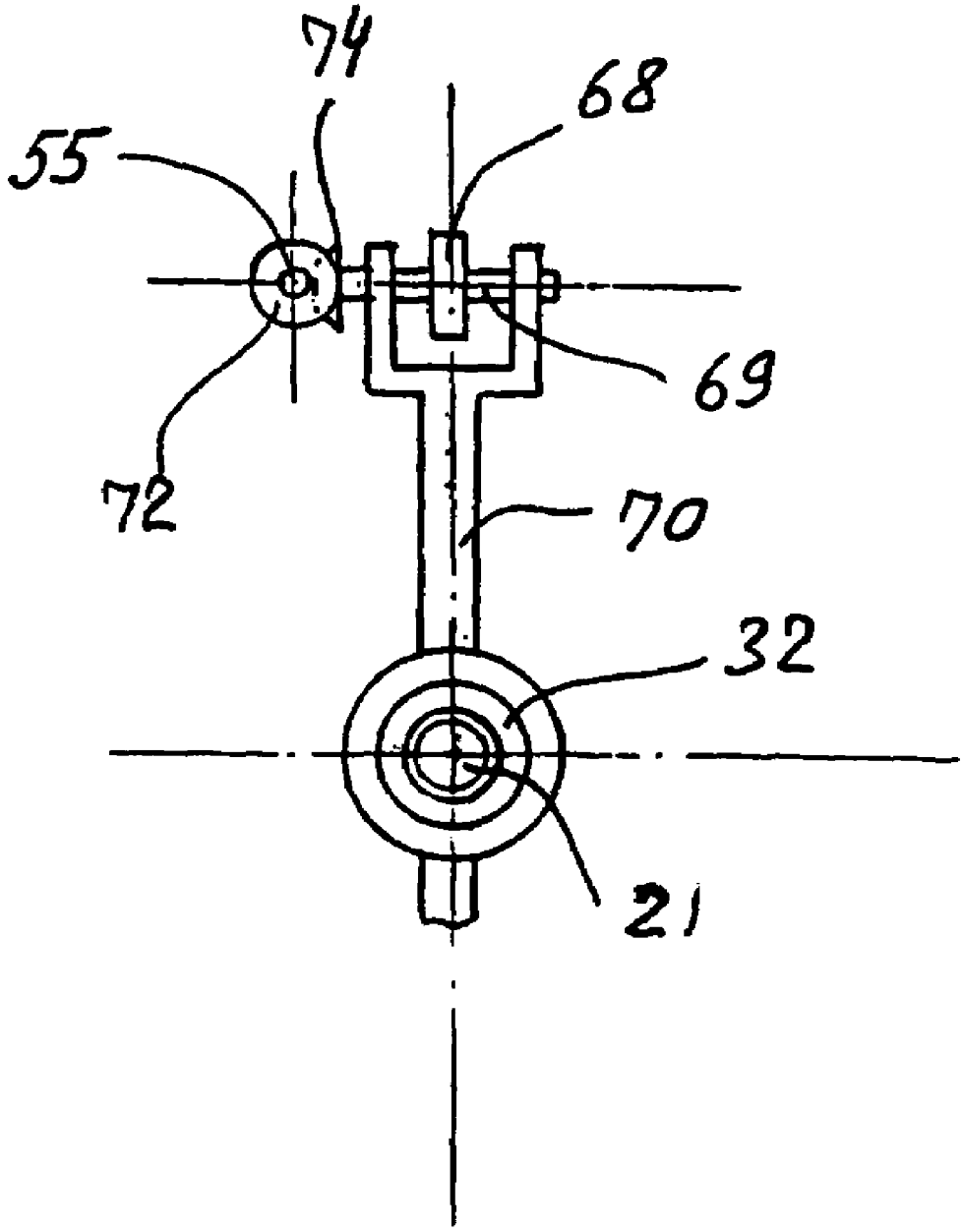
FIG. 2D is a fragmentary sectional view taken on line I-I in FIG. 2A showing a driving line for the conveyer-drawing chains, with some parts omitted for the sake of clarity.

All chains have a plurality of displacing members 76*a* and 76*b*. Each chain link has either displacing member 76*a* or displacing member 76*b* (FIG. 2C). Each displacing member comprises a guide semi-ring 77 for fiber support. For the sake of clarity, we do not illustrate the displacing members over all the chain sections in FIG. 2A. Wheels 68 are mounted on radial arms 48 and 70, and wheels 68' are mounted on radial arms 70' and 70" for rotation. Arms 70 support shafts 69, which carry wheels 68 and beveled gears 74 (FIG. 2D). Gears 74 are engaged with beveled gears 72 carried by shafts 55 which are mounted on arms 46 for rotation (FIGS. 2A and 2D). Wheels 68 can be moved along and secured in guide slots 50 of arms 48, divergence angle α between the chain sections and the central axis being changed. Heights of arms 70' and 70" are adjustable, and the arms can be moved and secured along support 32. Angle α is the same for each chain section 66, 66*a*, or 66*b*, but can be either different or the same for different sections. The chains slide along supporting parts 78, 78', and 78" to prevent chain sagging under drawing forces. These parts are stationary, supported by arms 48, 70', 70", and 70, and their inclination angle with respect to the central axis can be changed along with the change of angle α for each chain section.

As shown in FIGS. 2A and 2B, sections 66, 66*a*, and 66*b* pass over double guide chain wheels 68' so that the delivery end of each chain section overlaps with the receiving end of the next chain section. Since adjacent receiving and delivery ends are circumferentially spaced, they support different portions of the fiber loops moved by the circulating chains along the central axis.

This changes contact points between the fiber and the fiber displacing members thus resulting in better uniformity of dimensions and physical properties of the drawn fiber.

FIGS. 2A-2E—Operation

The chains are driven by means of electric motor 27*a*, gear 25*a*, shaft 21, the adjustable transmission (not shown), wheel 60, chain 58, wheels 56, gears 72 and 74, and wheels 68 and 68' (FIGS. 2A, 2B, and 2D). Both flyers 22 and 24, rotated in opposite directions, make one revolution while chains 66, 66*a*, and 66*b* move one chain pitch. Flyer 22 lays coiled fiber loops about the receiving ends of chains 66 placing each loop in contact with guide semi-rings 77 of displacing members 76*a* and 76*b* (FIG. 2C) which facilitate the fiber loop conveying along the central axis and the fiber drawing. The rest of the operation is the same as in case of the embodiment of FIG. 1A.

FIGS. 3A-3G—Another Embodiment

Figure 3A:
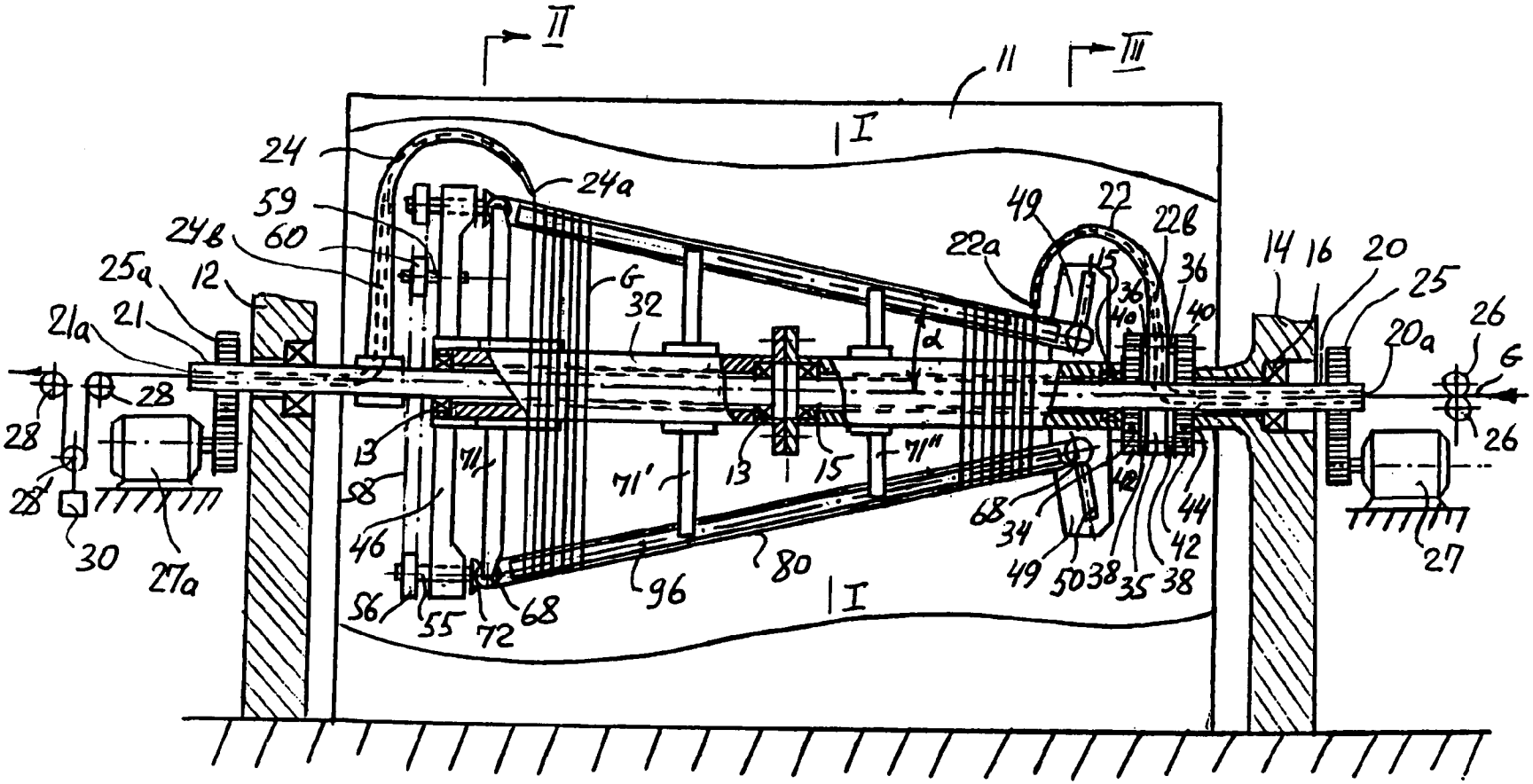
FIG. 3A is a longitudinal view illustrating another embodiment of the present invention where each conveyer-drawing member consists of a pair of parallel circulating endless chains.
Figure 3B:
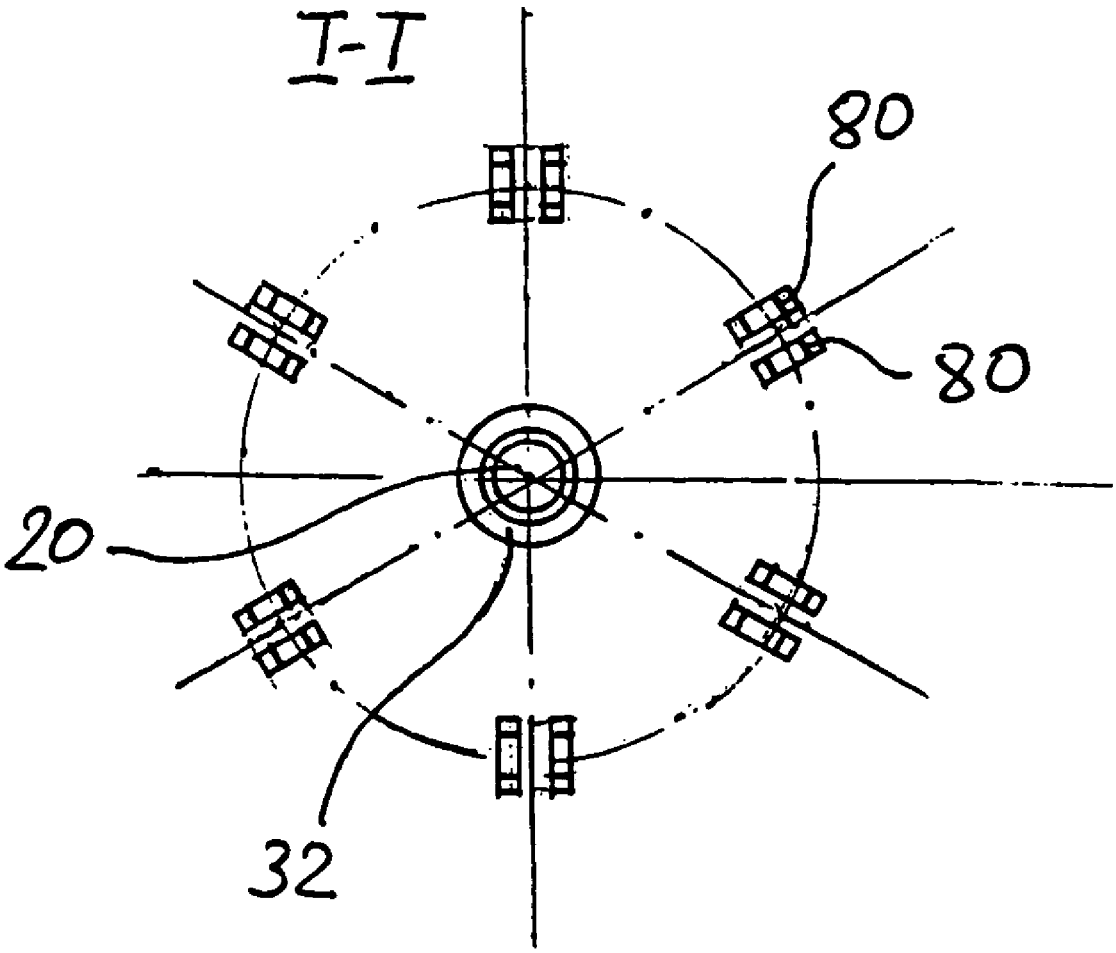
FIG. 3B shows, in schematic sectional view taken on line I-I in FIG. 3A, pairs of chains arranged in an equilateral hexagon.

The embodiment illustrated in FIGS. 3A-3G corresponds to the embodiments of FIGS. 1A-2D and corresponding parts have the same reference numbers. In the conveyer-drawing structure, the six chains having sections 66, 66*a*, and 66*b* (FIG. 2A) are replaced by six pairs of parallel circulating endless chains 80 which are not subdivided in three separate section each as in the embodiment of FIG. 2A. These six chain pairs are arranged in an equilateral hexagon when viewed in the cross-section (FIG. 3B). They pass over wheels 68 at both the receiving and delivery ends. The chains slide along supporting parts 96 to prevent chain sagging under drawing forces. These parts are stationary, supported by radial arms 71, 71', 71", and 49, and their inclination angle with respect to the central axis can be changed along with the change of divergence angles α of chains 80.

Figure 3C:
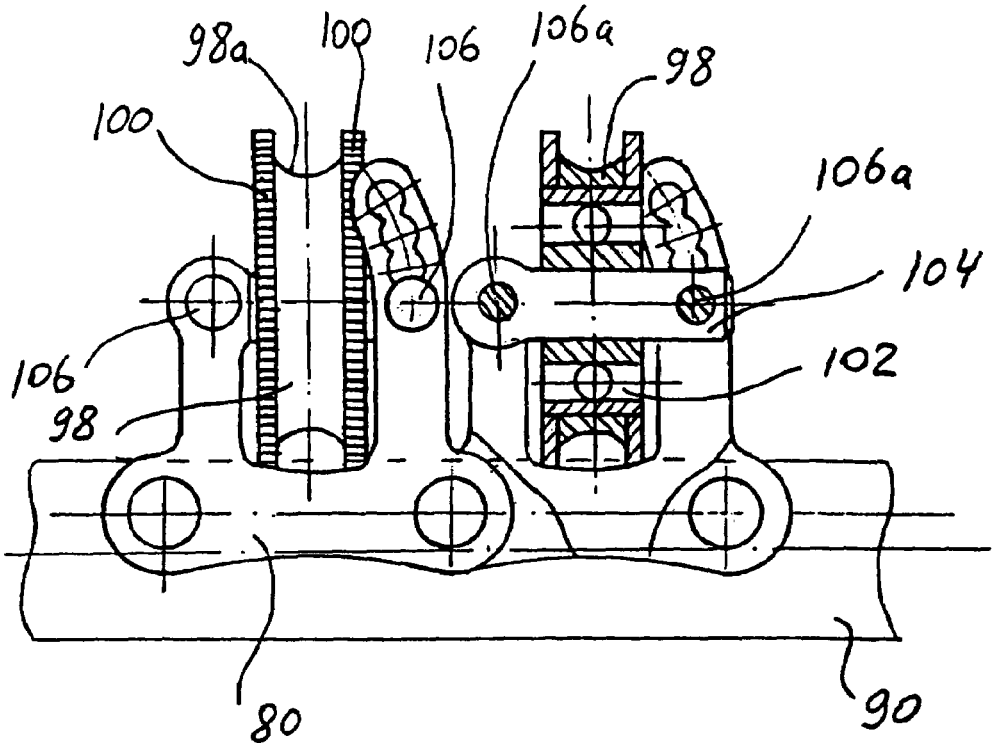
FIG. 3C is a fragmentary view of rollers mounted on the conveyer-drawing chains for embodiment of FIG. 3A.
Figure 3D:
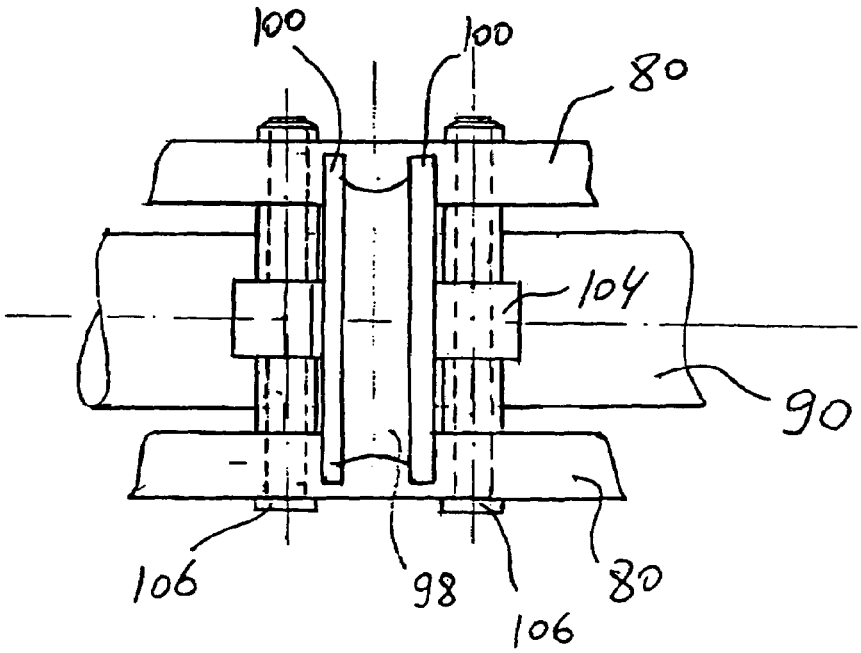
FIG. 3D is a fragmentary view of rollers mounted on the conveyer-drawing chains for embodiment of FIG. 3A.

Displacing members are mounted on the parallel chains. They comprise rollers 98 having circular circumferential grooves 98*a*, pins 106 and 106*a*, shafts 104, and ball bearings 102 (FIGS. 3C and 3D). Each pair of the parallel chains is joined by pins 106 and 106*a*. Each pair of chain links (one link from each chain) is joined by either two pins 106 or two pins 106*a*. Lateral parts of the chains are modified to support the pins. Each pair of pins 106 and 106*a* supports a shaft 104 which carries roller 98 with ball bearing 102. The axes of shafts 104 are adjusted nearly parallel to the central axis of the drawing apparatus while the fiber draw ratio is changed by varying divergence angle α of chains 80. To achieve this, the angle between shafts 104 and the chain is adjusted for each roller 98 by rotating shafts 104 around pins 106 and 106*a*. Other pins 106 and 106*a* are moved along and secured to the side portions of the chains (FIG. 3C). Gears 100 are attached to each side of rollers 98. For the sake of clarity we did not illustrate rollers 98 over all chains 80 in FIG. 3A.

Figure 3E:
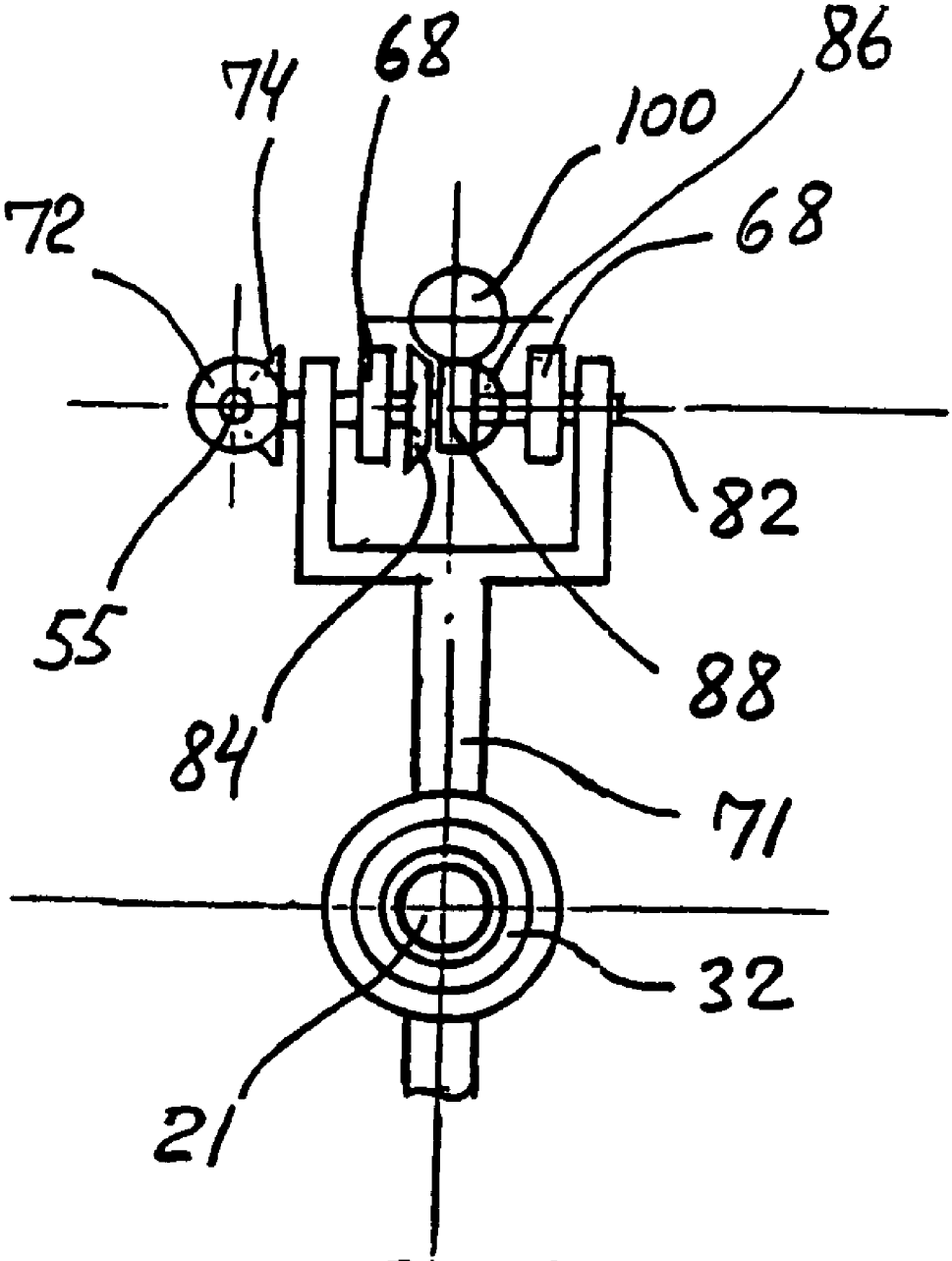
FIG. 3E is a fragmentary sectional view taken on line II-II in FIG. 3A showing a driving line for conveyer-drawing chains, with some parts omitted for the sake of clarity.
Figure 3F:
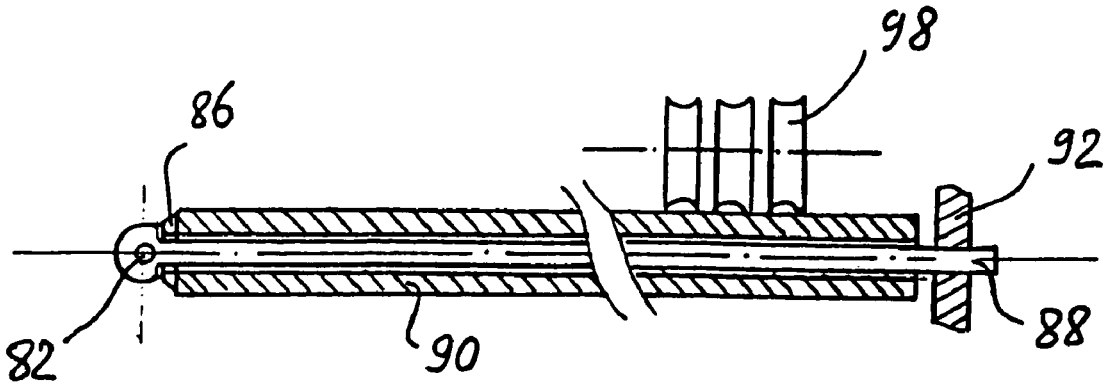
FIG. 3F is fragmentary view showing a driving line for the rollers supporting the fiber loops.
Figure 3G:
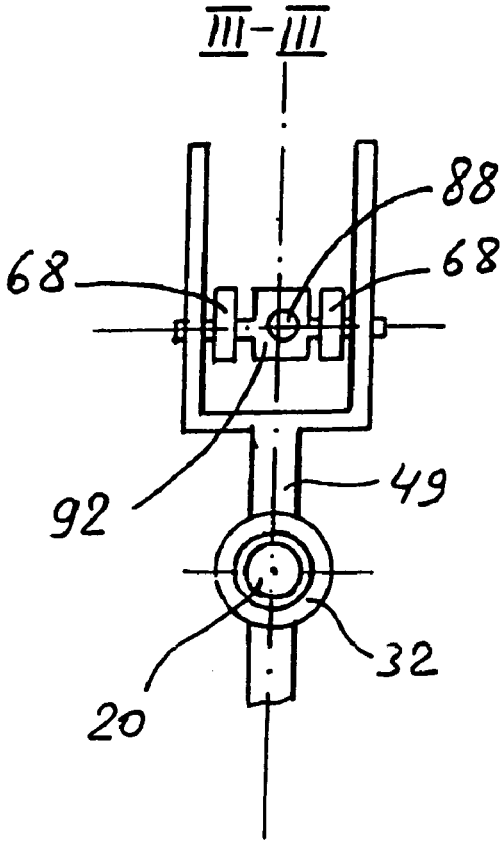
FIG. 3G is a fragmentary sectional view taken on line III-III in FIG. 3A, with some parts omitted for the sake of clarity.

Each shaft 82 mounted in arm 71 carries two wheels 68, a beveled gear 84, beveled gear 74, and supports one end of a shaft 88 (FIGS. 3E and 3F). Beveled gears 84 are engaged with beveled gears 86 fastened to long gears 90. Gears 86 and 90 are mounted on shafts 88 (FIG. 3F). Gears 90 are engaged with gears 100 of rollers 98 (FIGS. 3C-3F). The other end of shaft 88 is supported by shaft 92 (FIG. 3G). Shafts 92 are supported by arms 49 and can be moved along and secured in guide slots 50. As this takes place, shafts 88 turn around shafts 82, and gears 86 roll around gears 84, both gears remaining engaged. Two wheels 68 are mounted on each shaft 92 (FIG. 3G).

FIGS. 3A-3G—Operation

Chains 80 are driven by means of electric motor 27*a*, gear 25*a*, shaft 21, the adjustable transmission (not shown), wheel 60, chain 58, wheels 56, gears 72 and 74, and wheels 68 (FIGS. 3A and 3E). At the same time, gears 84 rotate gears 86 and long gears 90 (FIGS. 3E and 3F). Gears 90 rotate gears 100 and rollers 98 while rollers 98 are moved by chains 80 from the receiving ends, along gears 90, to the delivery ends. Flyers 22 and 24, rotated in opposite directions, make one revolution while chains 80 move one chain pitch. Flyer 22 lays successive, coiled equilateral hexagonal fiber loops about the receiving ends of chains 80 placing each loop in grooves 98*a* of rollers 98 (FIGS. 3C and 3D) and forming the layer of coiled fiber loops supported by the rollers. Rollers 98, as a part of the displacing members, facilitate the fiber loop conveying along the central axis and the fiber drawing. As the fiber loops travel to the left along the central axis, as viewed in FIG. 3A, the coil fiber loops are rotated about the central axis by rotating rollers 98. This changes contact points between the fiber and the rollers thus resulting in a better uniformity of dimensions and physical properties of the drawn fiber. Rotation speed of rollers 98 and the fiber coil is adjustable. The rest of the operation is the same as in case of embodiments of FIGS. 1A and 2A.

The apparatus can be used with rollers 98 not being rotated by the driving mechanism. In this instance, the coiled fiber loops, supported by free-to-rotate rollers, are not rotated about the central axis. In some cases, this is sufficient to produce the drawn fiber having uniformity of the dimensions and physical properties along the fiber axis.

Figure 4A:
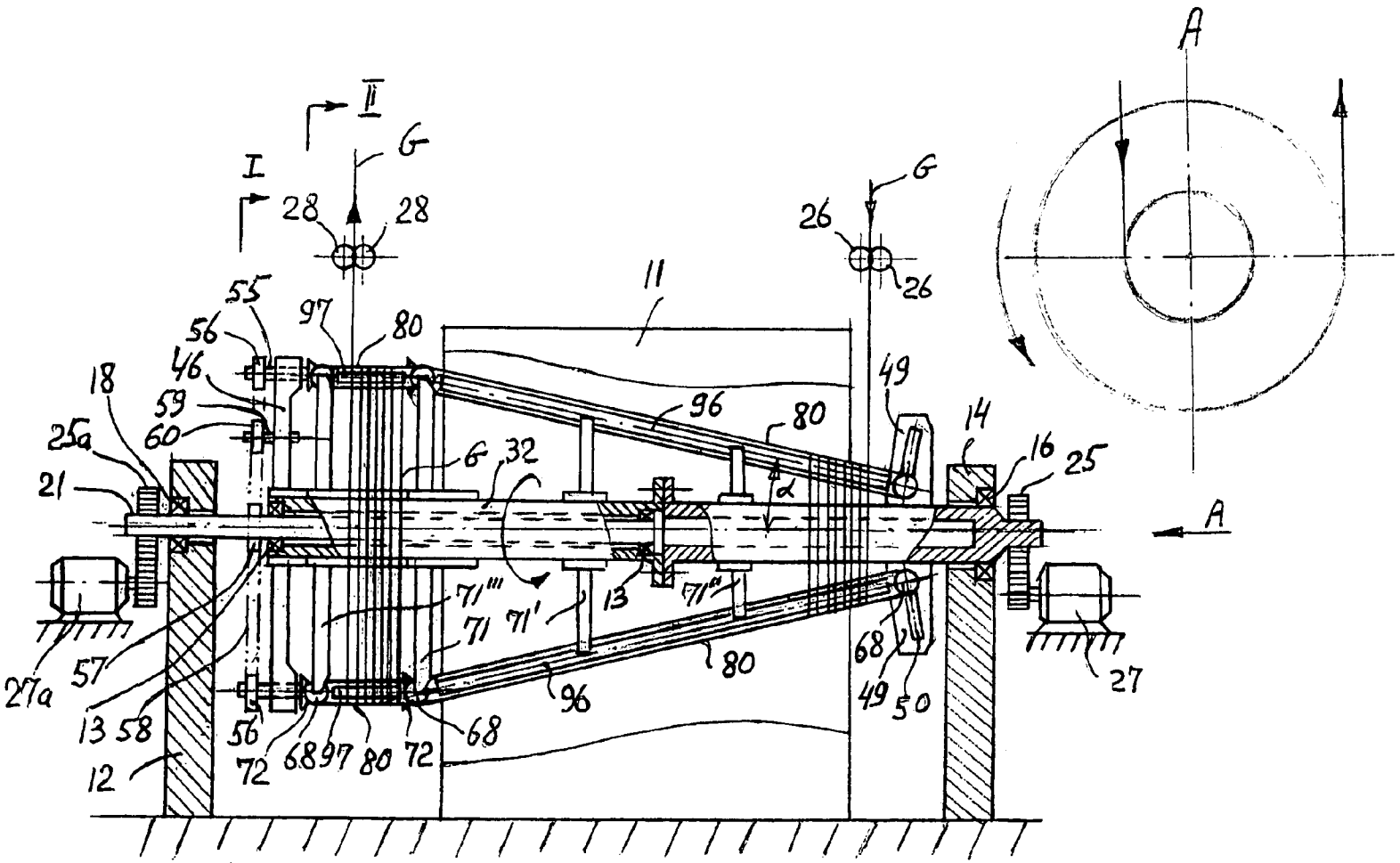
FIG. 4A is a longitudinal view illustrating another embodiment of the present invention where whole conveyer-drawing structure rotates about the central axis.
Figure 4B:
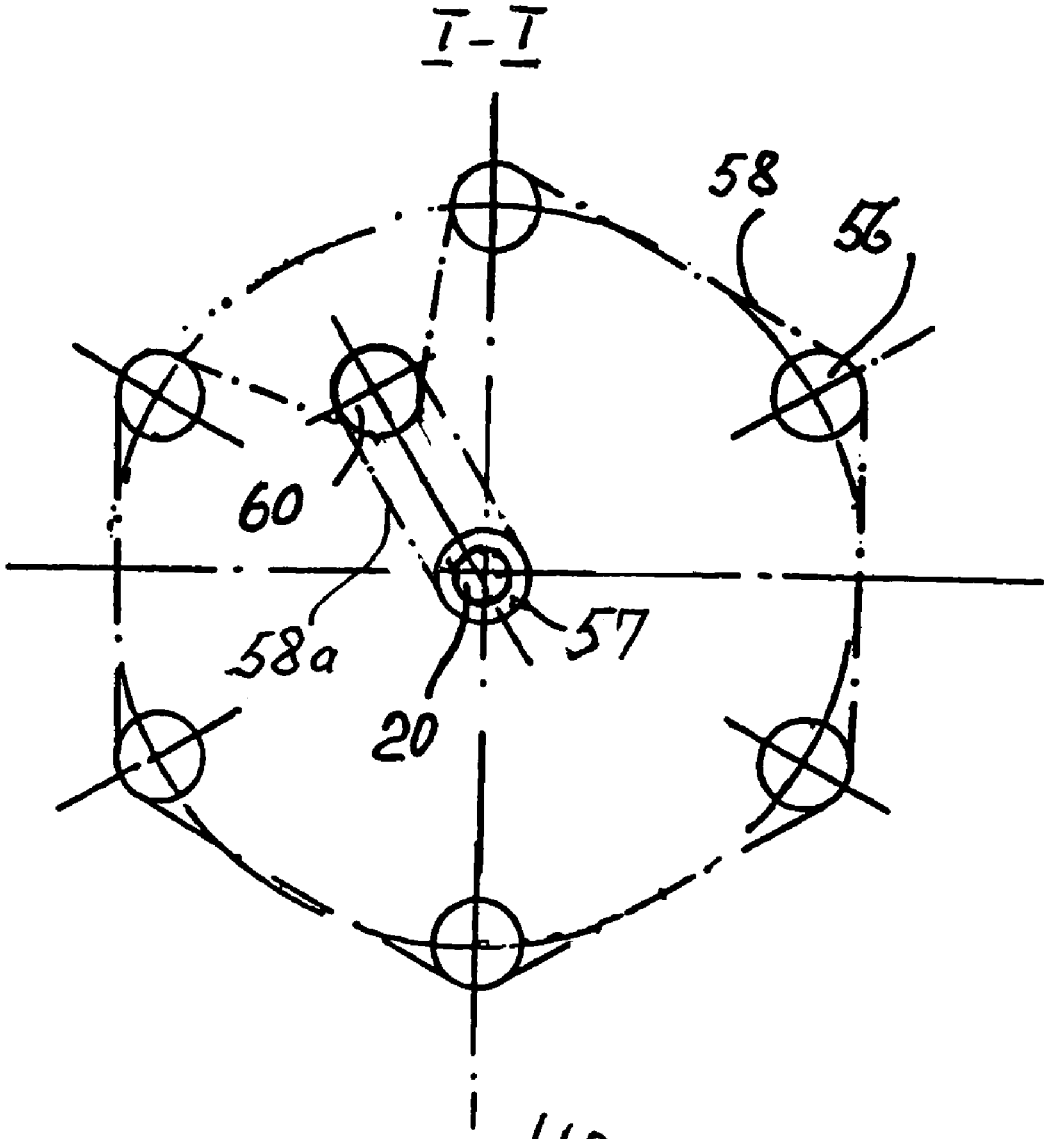
FIG. 4B shows, in schematic sectional view taken on line I-I in FIG. 4A, chain wheels for driving the conveyer-drawing chains arranged in an equilateral hexagon.
Figure 4C:
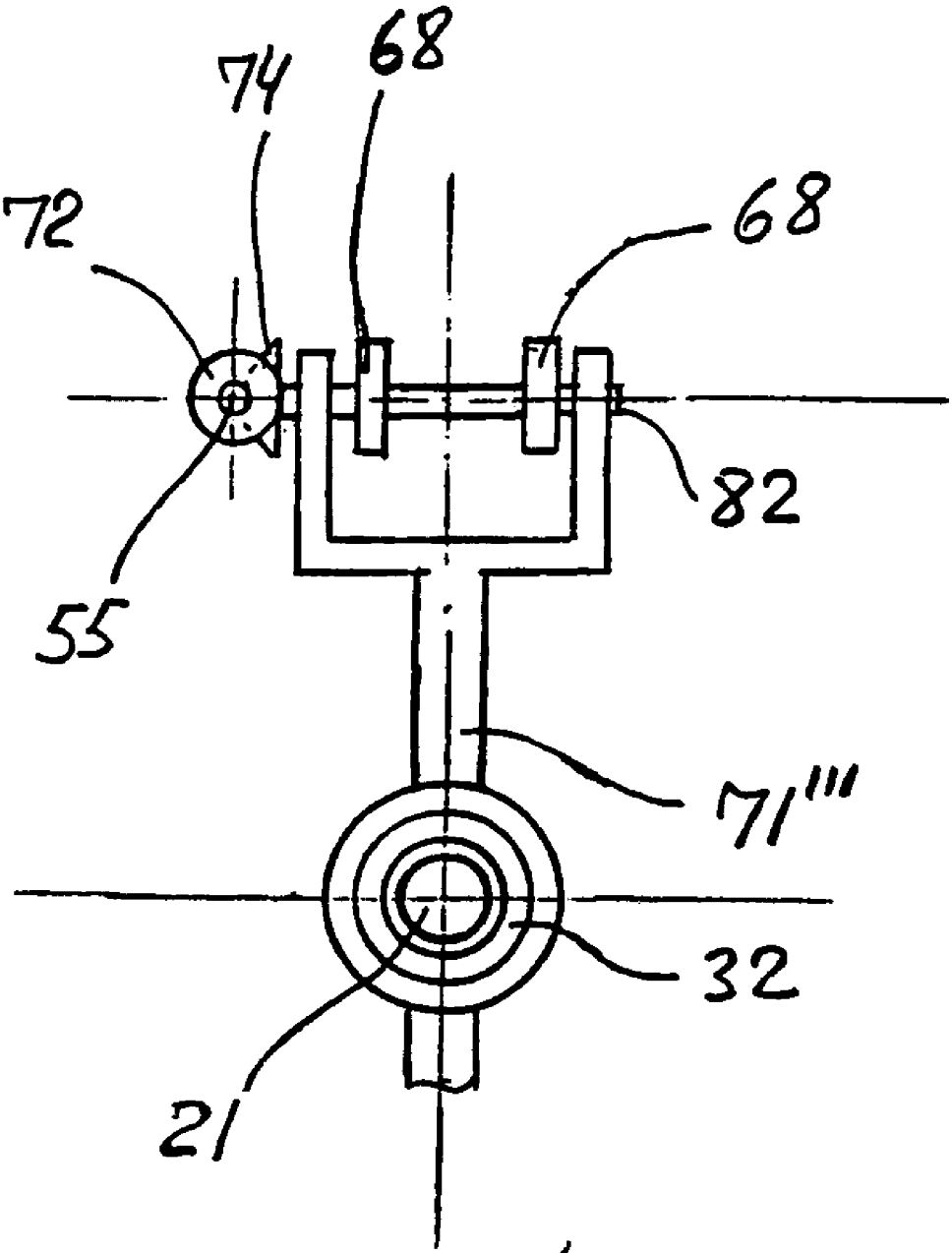
FIG. 4C is a fragmentary sectional view taken on line II-II in FIG. 4A showing a driving line for conveyer-drawing chains, with some parts omitted for the sake of clarity.

FIGS. 4A-4C—Another Embodiment

The embodiment illustrated in FIGS. 4A-4C corresponds to the embodiments of FIGS. 1A-3A and corresponding parts have the same reference numbers. As in the embodiment of FIG. 3A, this embodiment has a conveyer-drawing structure comprising six pairs of parallel circulating endless chains 80 arranged in an equilateral hexagon when viewed in the cross-section (as illustrated in FIG. 3B) and positioned at changeable divergence angle $\alpha$ to the central axis. In this embodiment, the receiving and delivery ends of the conveyer-drawing structure are arranged outside of heat chamber 11. At the delivery ends, the conveyer-drawing structure has a section outside the heat chamber where chains 80 are arranged in parallel to the central axis. This embodiment, in comparison with the embodiment of FIG. 3A, has additional supporting parts 97 and radial arms 71''' supporting chain wheels 68. Supporting parts 97 are supported by radial arms 71 and 71'''(FIG. 4A).

In this embodiment shafts 55 are longer than in the embodiment of FIG. 3A, and each one carries two beveled gears 72 (FIG. 4A) engaged with beveled gears 74 (FIG. 4C). A chain wheel 57 is secured to shaft 21. Chain 58 passes over wheels 56 and wheel 60, and a chain 58*a* passes over wheels 60 and 57 (FIG. 4B).

The fiber displacement members, rollers 98, are mounted on chains 80 by the same way as illustrated in FIGS. 3C and 3D. In this embodiment (as in the embodiment of FIG. 3A) gears 100 of rollers 98 are engaged with long gears 90 (FIGS. 3E and 3F) mounted on shaft 88 between radial arms 49 and 71. Rollers 98 support the fiber loops from the receiving to delivery ends.

FIGS. 4A-4C—Operation

In this embodiment, the conveyer-drawing structure is not stationary. The whole structure (comprising tubular support 32, radial arms 46, 49, 71, 71', 71'' and 71''', conveyer-drawing chains 80, chain wheels 68, beveled gears 72 an 74, shafts 82 and 88, gears 84 and 86, long gears 90, rollers 98 with gears 100, chains 58 and 58*a*, shafts 55, and supporting parts 96 and 97) is rotated about the central axis by means of electric motor 27 and gears 25 (FIG. 4A).

Chains 80 are driven by means of electric motor 27*a*, gear 25*a*, shaft 21, chain wheel 57, chain 58*a*, wheel 60, chain 58, wheels 56, gears 72 and 74, and wheels 68 [gears 72 and 74, and wheels 68 being mounted on both radial arms 71''' (FIG. 4C) and 71 (as illustrated in FIG. 3E)]. Chains 80 slide along supporting parts 96 and 97 to prevent their sagging and pass over wheals 68 supported by radial arms 49, 71, and 71'''. Rollers 98 mounted on chains 80 are rotated about their axes by the same way as in the embodiment of FIG. 3 (FIGS. 3E and 3F) while they move along the central axis between radial arms 49 and 71. The rotation promotes rotation of the fiber loops around the central axis resulting in that the fiber does not have permanent contact points with the rollers. Rollers 98 are not driven while they move between radial arms 71 and 71''' (FIG. 4C), but the rollers continue to rotate about their axis and the fiber loops continue to rotate about the central axis by pulling the fiber off the delivery ends by rollers 28.

The rotating conveyer-drawing structure promotes winding of fiber G on the receiving ends of conveyer-drawing chains 80 in the form of successive, coiled equilateral hexagonal fiber loops (FIG. 4A). These loops are conveyed along the central axis and drawn inside of heat chamber 11 by the same way as in case of the embodiment of FIG. 3A. After the heat chamber, the fiber loops are conveyed without drawing (along the section with chains 80 arranged in parallel to the central axis) and cooled down. At the delivery ends, their unwinding is promoted by the rotation of the conveyer-drawing structure (FIG. 4A). The rest of the operation is the same as in case of the embodiments of FIGS. 1A-3A.

This embodiment is especially operator friendly. To start the process an operator turns driving motors 27 and 27*a* off, loads the fiber to the receiving ends (outside of the heat chamber) using an air gun, and clamps it to one of the fiber displacing members (rollers 98). The operator turns driving motors on, and the apparatus starts to lay continuously the successive fiber loops around the receiving ends of circulating conveyer-drawing chains 80, convey the loops along the central axis towards the delivery ends, and draw them. Thus, the apparatus loads all the fiber loops (possibly several tens or several hundreds) on rollers 98 mounted on chains 80 from the receiving to delivery ends. When the fiber end reaches the delivery ends (outside the heat chamber), the operator turns the driving motors off, unclamps the fiber, sucks the fiber end in the air gun, turns the motors on, and takes the fiber up to a winder or next stage of the fiber making process. Thus, the process of loading the fiber loops on the apparatus is semi-automatic. In case of broken fiber, the chains convey the broken ends to the delivery ends (outside the heat chamber) where the operator can easily handle them.

Figure 5A:
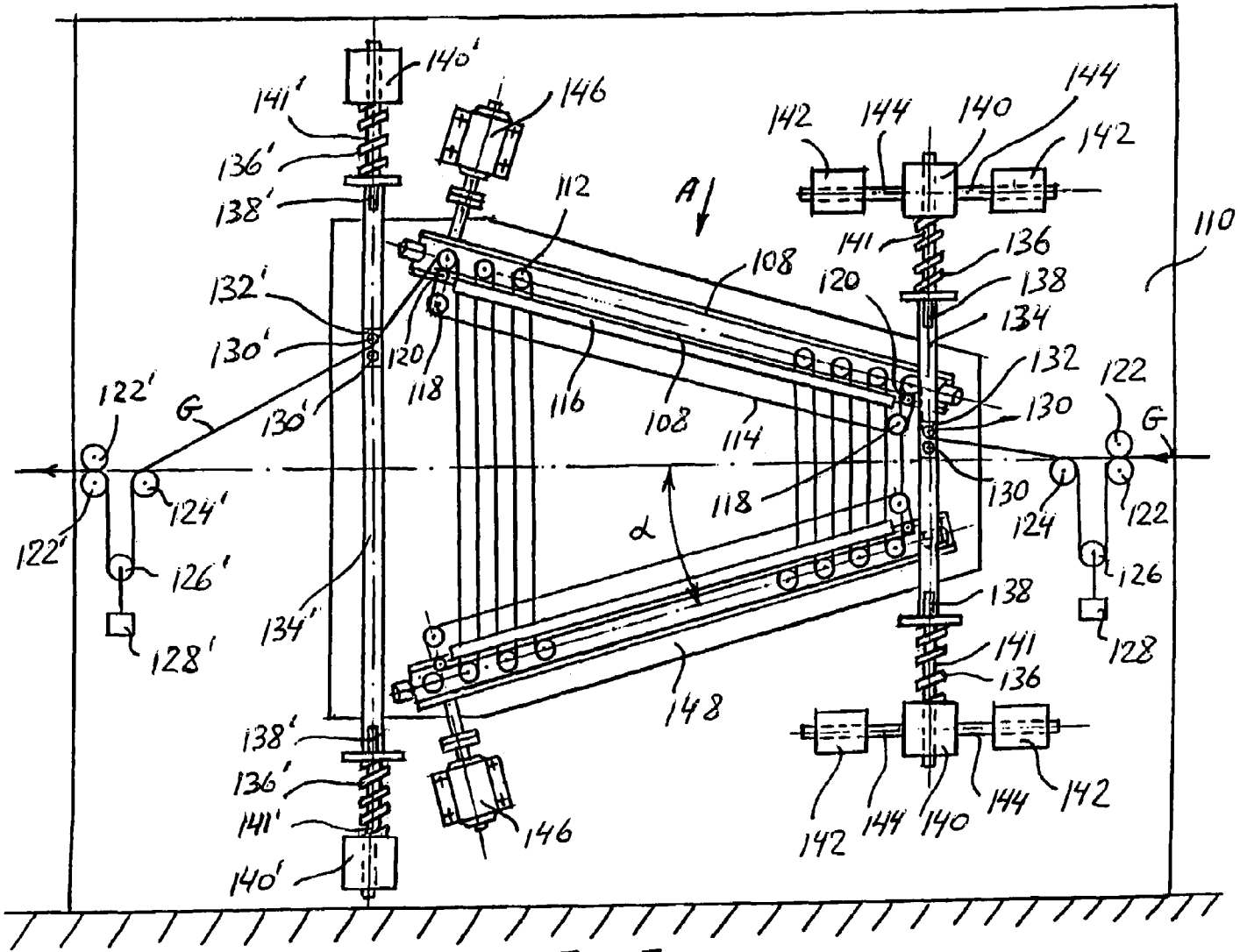
FIG. 5A is a longitudinal view illustrating another embodiment of the present invention for drawing of the fiber in the form of coiled serpentine loops.
Figure 5B:
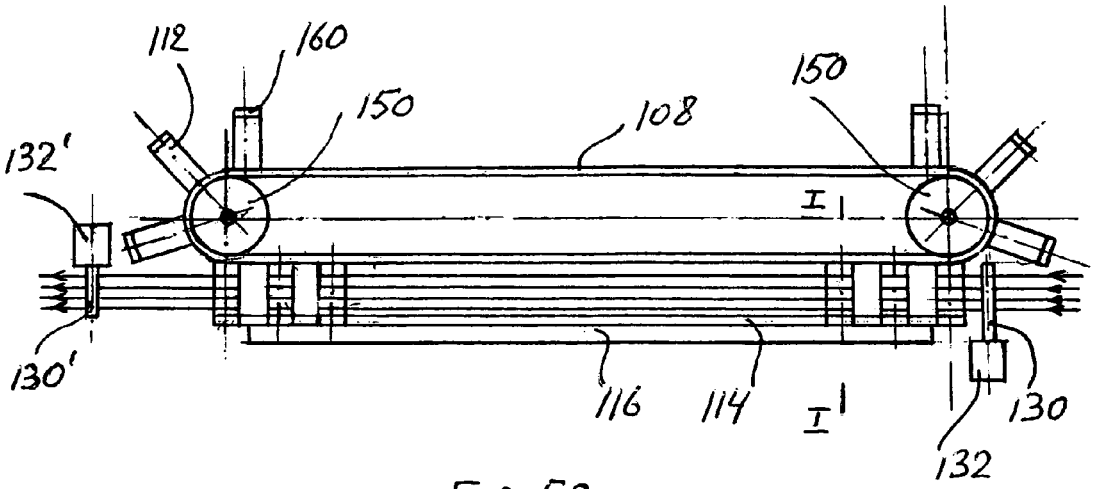
FIG. 5B is a fragmentary view down an arrow A in FIG. 5A.
Figure 5C:
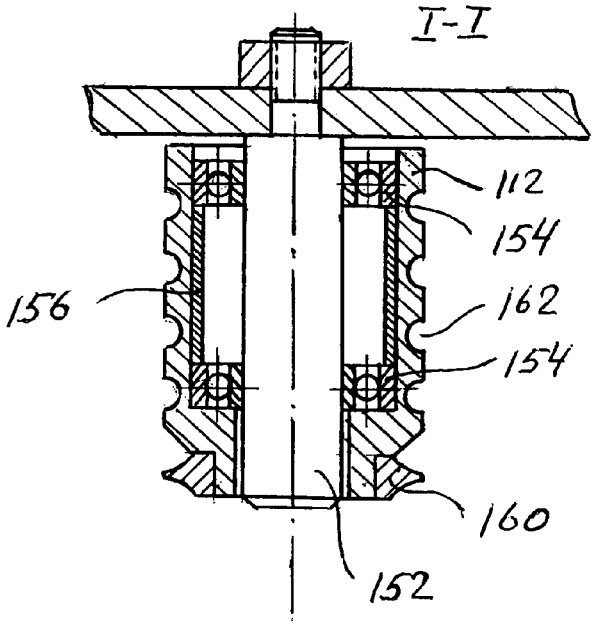
FIG. 5C is a fragmentary sectional view of one roller mounted on the conveyer-drawing chains taken on line I-I in FIG. 5B.

FIGS. 5A-5C—Another Embodiment

An embodiment of the invention for continuous drawing of fibers in form of coiled serpentine fiber loops (the coiled serpentine fiber loops are one of the form of the coiled fiber loops, according to the definition presented above) is illustrated in FIGS. 5A-5C. FIG. 5A shows a longitudinal view of an invented drawing apparatus. Just as in the previous embodiments described above, the drawing apparatus has the following main parts: (a) a conveyer-drawing structure for conveying and simultaneous drawing of fiber G (single end or multiple ends), (b) a feed device for feeding of fiber G to the conveyer-drawing structure at an inlet speed and laying continuously the successive serpentine fiber loops on receiving ends of the conveyer-drawing structure, (c) a take-off device for taking continuously off the leading fiber loops from delivery ends of the conveyer-drawing structure and conveying the drawn fiber from the fiber drawing apparatus either to the next stage of the fiber making process or to the receiving package at an outlet speed, (d) driving mechanisms for driving parts of the conveyer-drawing structure, and (e) a heat chamber for heating fiber G while the fiber being conveyed and drawn. For a detailed description see below.

(a) The conveyer-drawing structure comprises two conveyer-drawing members. Each conveyer-drawing member comprises a pair of parallel circulating endless chains 108 and a plurality of rollers 112, as displacing members, mounted on the conveyer-drawing members and placed between chains 108 (FIGS. 5A and 5B). Each roller 112 has a shaft 152, two ball bearings 154, a spacer 156, a chain wheel 160, and multiple circular parallel grooves 162 for handling of parallel multiple fiber ends (FIG. 5C). For the sake of clarity, we do not illustrate the rollers over all the chains in FIGS. 5A and 5B.

Just as in the previous embodiments described above, the conveyer-drawing members are disposed about a central axis and have receiving ends for receiving the fiber and delivery ends for delivering the fiber and both the receiving and delivery ends are spaced along the central axis. The delivery ends are spaced further from the central axis than the receiving ends. The conveyer-drawing structure, as well as other parts of the drawing apparatus, is supported by a vertical supporting housing 110. Each chain 108 passes over two chain wheels 150 mounted on housing 110 (FIG. 5B).

There are two endless circulating chains 114 (each for one pair of chains 108). Each chain 114 passes over two chain wheels 118 and two rollers 120. One wheel 118 for each chain 114 is driven by an electric motor (not shown). Chains 114 are engaged with chain wheels 160 of rollers 112. Chains 114 slide along supporting parts 116 to prevent their sagging as well as sagging of chains 108 with rollers 112 under drawing forces. Parts 116 are stationary and are mounted on housing 110.

(b) The feed device comprises a pair of driven feed rollers 122, a roller 124, a roller 126, a weight 128, a feed flyer 132 with two free-to-rotate rollers 130, guide 134, two springs 136, two plungers 138, two solenoids 140 with cores 141, and four solenoids 142 (two for each solenoid 140) with cores 144.

(c) The take-off device comprises a pair of driven conveying rollers 122', a roller 124', a roller 126', a weight 128', a take-off flyer 132' with two free-to-rotate rollers 130', a guide 134', two springs 136', two plungers 138', and two solenoids 140' with cores 141'.

(d) The driving mechanisms for chains 108 comprise electric motors 146 (one motor per one pair of chains 108). Each motor 146 drives two chain wheels 150 (one wheel for each chain 108).

(e) The heat chamber 148 is supplied with hot air, hot inert gas, or superheated steam. It envelops the conveyer-drawing members, the serpentine fiber loops, and part of the feed and take-off devices.

FIGS. 5A-5C—Operation

Chains 108 are driven by means of electric motors 146 and gears 150 (FIGS. 5A and 5B). Chains 108 carry rollers 112 conveying them from the receiving ends to the delivery ends and backward. Motors 146 have adjustable speed. Upper chain 114 circulates in counter-clockwise direction while lower chain 114 circulates in clockwise direction. Thus, parts of chains 114, which engaged with chain wheels 160 of rollers 112, move in the same direction as chains 108. Chains 114 have linear speed slightly lower than that of chains 108. In the process, rollers 112 are slowly rotated in such direction that the points of the fiber serpentine loops are moved along the fiber axis or, in other words, along the serpentine line. This changes contact points between the fiber and the rollers resulting in better uniformity of dimensions and physical properties of the drawn fiber.

Fiber G (single end or parallel multiple ends) comes to feed rollers 122 at an inlet speed either from a previous stage of the fiber making process (e.g., spinning, previous stage of drawing, etc.) or from feeder packages. The fiber ends come to feed flyer 132, curve around roller 130, and come to rollers 112 (FIGS. 5A and 5B). Rollers 130 and 130' have multiple circular parallel grooves (not shown) similar to those on rollers 112 for handling the parallel multiple fiber ends.

Flyer 132 moves up and down along guide 134 by the same manner as in the weaving operation in textile industry, i.e., it is struck in turns by plungers 138 at the top and bottom of guide 134. Solenoids 140 draw in cores 141, compress springs 136, and lead up plungers 138 in percussive position. The springs are released by the solenoids in turns at certain time, the plungers hit the feed flyer, and the flyer moves along the guide carrying the fiber ends. Locking devices (not shown) can stop flyer 132 at the top and bottom of guide 134 allowing plungers 138 to hit the feed flyer at proper time. An assembly of parts of the feed device comprising solenoids 140, cores 141, springs 136, plungers 138, guide 134, and feed flyer 132 with rollers 130 has short-distance horizontal reciprocal motion by means of solenoids 142 (two on the top and two on the bottom of the apparatus) and cores 144. This combination of vertical and horizontal motions of flyer 132 provides more flexibility and precision in the apparatus operation.

Thus, feed flyer 132 lays successive coiled serpentine loops on rollers 112 at the receiving ends of chains 108. The fibers are placed in grooves 162. The newly laid fiber loops travel to the left along the central axis, as viewed in FIG. 5A, from the receiving to delivery ends freeing room for the next laid fiber loops. Parallel layers of the serpentine fiber loops are formed on chains 108 and rollers 112, i.e., one layer for each fiber end. Rollers 112 serve as a fiber displacing members facilitating conveying the fiber loops along the central axis and simultaneous fiber drawing by expanding the circumference of the fiber loops. Thus, the fibers are gradually drawn at the heat chamber temperature.

The successive leading loops of drawn fibers are continuously taken off at the delivery ends by the take-off device operating by the same manner as the feed device described above besides that the take-off device does not have horizontal reciprocal motions. Motions of all parts of the drawing apparatus should be synchronized.

The rest of the operation is the same as in the case of the embodiments of FIGS. 1A-3A.

Calculations

As discussed above, the invented continuous drawing method provides that fiber linear speed $(V_{fiber})_{max}$ the drawing process is lower than outlet speed $V_{outlet}$ (the ratio of $V_{outlet}$ to $(V_{fiber})_{max}$ is greater than 1 to 1). At the same time, strain rate $V_{strain}$ is substantially lower and drawing time T is longer than those in the existing industrial processes without reducing, and in some cases even increasing, the throughput. The following calculations, made for the embodiments of FIGS. 1A-5A, support these statements.

A speed of conveying the fiber loops along the central axis $V_{loop}$ is given by $$V_{loop}=d/\Delta T \text{ and} \tag{6}$$

$$\Delta T=d/V_{loop}, \tag{7}$$

where d is a distance between adjacent loops in the fiber coil along the central axis, i.e., a pitch of the fiber coil and ΔT—time needed for the fiber loop to pass distance d.

According to the mass conservation rule, in a continuous fiber making process equal fiber mass should pass through any cross-sectional plane (plane perpendicular to the central axis) in a unit time both inside and outside the apparatus. For the fiber having the same draw ratio λ, the fiber mass is in proportion to the fiber length.

Inside the apparatus, at the delivery ends, a fiber length L, which is a circumference of the leading fiber loop at the delivery ends, passes cross-sectional plane for time ΔT (see above). Outside the apparatus, while the fiber being conveyed either to the next stage of the fiber making process or to the receiving package, the same length L of the straightened fiber (having the same λ) should pass cross-sectional plane for the same time ΔT. Thus, outlet speed $V_{outlet}$ is given by $$V_{outlet}=L/\Delta T, \tag{8}$$

Thus, equations (7) and (8) lead to a ratio A $$A=V_{outlet}/V_{loop}=L/d. \tag{9}$$

(a) The Case of the Embodiments of FIGS. 1A-4A with the Coiled Isosceles Polygonal Fiber Loops.

FIGS. 6A and 6B show, in schematic view, increase of fiber loop circumference from $L_i$ to $L_{i+1}$ while the loop passes distance d along the central axis that takes time ΔT. In case of the embodiments of FIGS. 1A-4A, the fiber loops are equilateral hexagons and consist of six equal fiber sections (FIG. 6B). Each section is drawn between two adjacent conveyer-drawing members. As an example, section KP becomes section FW. The length increase is FH+QW (lines KH and PQ are perpendicular to line FW; FH=QW). Each point of section KP is drawn at linear speed along the fiber axis $V_{fiber}$, which is different for different points of the section. Points K and P have the highest speed $V_{fiber}$, in the drawing process designated as $V_{fiberK}$ and $V_{fiberP}$. The middle point of section KP has speed $V_{fiber}=0$. Thus the highest value of fiber speed $V_{fiber}$ in the drawing process $(V_{fiber})_{max}$ is given by $$(V_{fiber})_{max}=V_{fiberK}=V_{fiberP}=QW/\Delta T=(PW\cdot\cos\phi_1)/\Delta T \tag{10}$$

From isosceles triangle POK (FIG. 6B) we get $$\phi_1=(180-\phi)/2 \tag{11}$$

In case where n conveyer-drawing members are arranged in an equilateral polygon, angle φ is given by $$\phi=360/n, \tag{12}$$

From equations (11) and (12) we get $$\phi_1=(180-360/n)/2=90\cdot(1-2/n) \tag{13}$$

From equations (10) and (13) we get $$(V_{fiber})_{max}=PW\cdot\cos[90\cdot(1-2/n)]1/\Delta T \tag{14}$$

From FIG. 6A we get $$PW=d\cdot tg\alpha \text{ and} \tag{15}$$

$$(V_{fiber})=d\cdot tg\alpha\cdot\cos[90\cdot(1-2/n)]\sim 1/\Delta T \tag{16}$$

From equations (6) and (16) we get $$(V_{fiber})_{max}=V_{loop}\cdot tg\alpha\cdot\cos[90\cdot(1-2/n)] \tag{17}$$

From equations (9) and (17) we get $$(V_{fiber})_{max}=V_{outlet}\cdot d\cdot 1/L\cdot tg\alpha\cdot\cos[90\cdot(1-2/n)] \tag{18}$$

Thus, fiber speed $(V_{fiber})_{max}$ is constant during the drawing at given $V_{outlet}$, d, L, n, and α

Equation (18) leads to a ratio B $$B=V_{outlet}/(V_{fiber})_{max}=L/\{d\sim tg\alpha\cdot\cos[90\cdot(1-2/n)]\} \tag{19}$$

Figure 7:
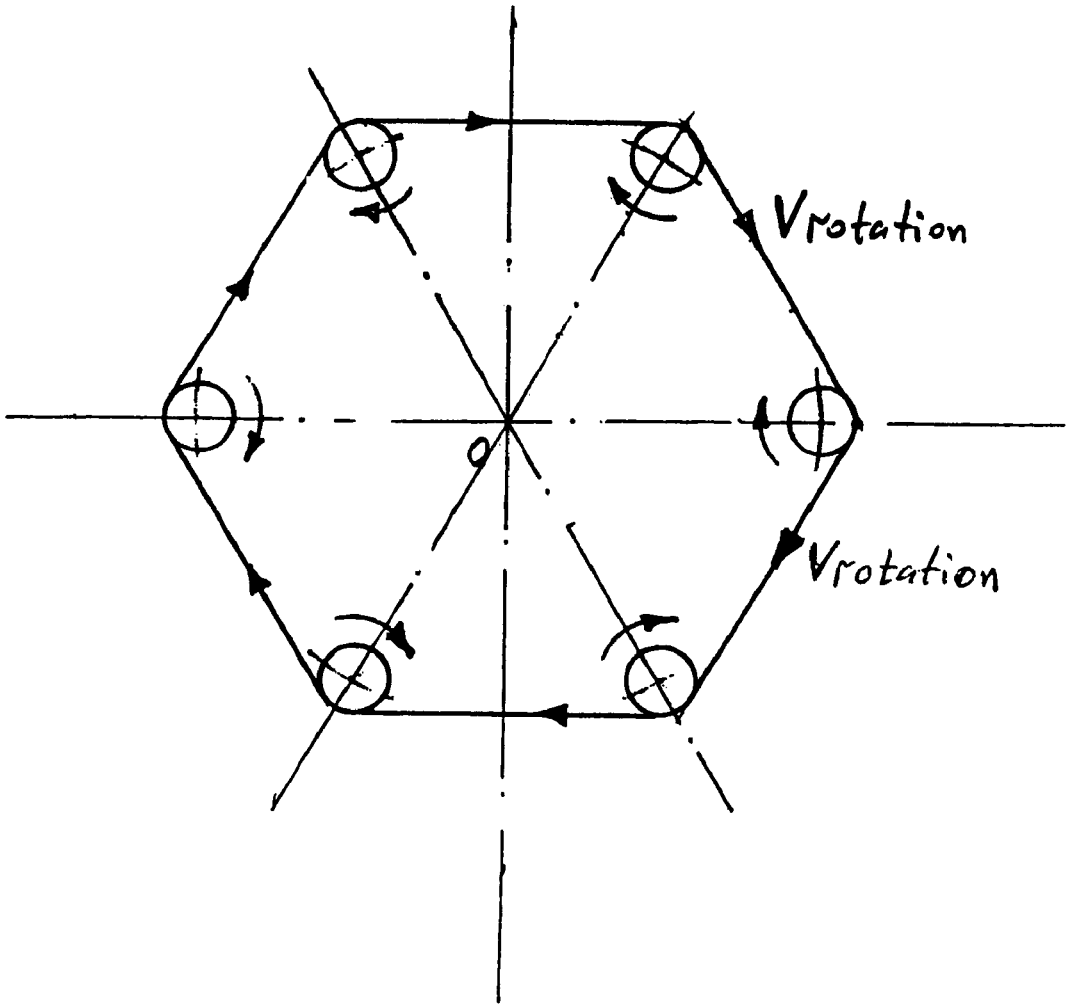
FIG. 7 shows linear speeds of fiber points in case of the rotation of the fiber coil about the central axis clockwise by rotating spindles or rollers.

In case of rotation of the coiled fiber loops about the central axis by the rotating rollers or spindles (like in the embodiments of FIG. 1A and FIG. 3A), each point of the fiber loop rotates with a linear speed $V_{rotation}$, which is a linear surface speed of the rollers or spindles (FIG. 7). Each point of the fiber loop in the process of the rotation of the loop about the central axis passes a distance $L_{fiber}$ while the loop as a whole passes distance d along the central axis for time ΔT.

Distance $L_{fiber}$ is given by $$L_{fiber}=V_{rotation}\cdot\Delta T \tag{20}$$

From equations (8) and (20) we get $$L_{fiber}=(V_{rotation}/V_{outlet})\cdot L \tag{21}$$

During the drawing, while the fiber loop passes from the receiving to delivery ends, each point of the fiber loop in the process of the rotation of the loop about the central axis passes total distance designated as $L_{total}$, which is given by $$L_{total}=L_{fiber}\cdot(N-N')=(V_{rotation}/V_{outlet})\cdot L\cdot(N-N'), \tag{22}$$

where (N−N') is a number of the fiber loops passing the heat chamber for time of drawing T in case of rotation of the loops about the central axis by the rotating rollers or spindles, N is a number of the fiber loops in the heat chamber which is given by $$N=M/d, \tag{23}$$

where

M is a length of the fiber coil along the central axis, and

N' is a number of loops with an average circumference $L_{average}$ which have the total circumference equals $L_{total}$ (it is a reduction in number of the fiber loops passing the heat chamber for time of drawing T as a result of the rotation of the loops about the central axis relative to the case without the rotation) and is given by $$N'=L_{total}/L_{average}, \tag{24}$$

where the average circumference $L_{average}$ of the fiber loops in the heat chamber is given by $$L_{average}=(L+L')/2, \tag{25}$$

where

L' is the circumference of the first fiber loop at the receiving ends.

The draw ratio λ is given by $$\lambda=L/L' \text{ and} \tag{26}$$

$$L_{average}=(L+L/\lambda)/2 \tag{27}$$

From equations (22) and (24) we get $$N'=N/(L_{average}/L_{fiber}+1) \tag{28}$$

One can see that the larger the ratio $L_{average}/L_{fiber}$, the smaller N' in comparison with N.

Thus, time of drawing T, which is time needed for each fiber point to pass from the receiving ends to the delivery ends, in a view of equation (9), is given by $$T=(M-N'\cdot d)/V_{loop}=[A\cdot(M-N'\cdot d)]/V_{outlet}=[L\cdot(M-N'\cdot d)]/(V_{outlet}\cdot d) \tag{29}$$

From definition of ΔT, that is, time needed for the fiber loop to pass distance d between adjacent loops along the central axis (see APPENDIX, page 52), and in case of N'=0 we get $$\Delta T=T/(N-1) \tag{30}$$

From equations (8) and (30) we get $$V_{outlet}=[L\cdot(N-1)]/T \tag{31}$$

At large N $$V_{outlet}=(L\cdot N)/T \tag{32}$$

Equation (32) shows that $V_{outlet}$ is directly proportional to L and N and inversely proportional to T.

$$L=\pi\cdot D \tag{33}$$

were

D—diameter of the leading fiber loop at the delivery ends.

From equations (32) and (33) we get $$V_{outlet}=(\pi\cdot D\cdot N)/T \tag{34}$$

One can see that $V_{outlet}$ is proportional to D (or L) and N.

EXAMPLE 1

Table I gives the results of calculations for the case: L=5500 mm, $V_{outlet}=V_{take\text{-}up}$=3000 m/min (the fiber is conveyed to the receiving package after the drawing stage), n=6, λ=5 to 1 (400%), and d, M and A are variable. The coiled fiber loops are not rotated about the central axis by the rotating rollers or spindles. Take-up speed of 3000 m/min is typical take-up speed for the commercial process for multifilaments and yarns.

EXAMPLE 2

Table II gives results of calculations for the case: L=2000 mm, $V_{outlet}=V_{take\text{-}up}$==500 m/min (the fiber is conveyed to the receiving package after the drawing stage), n=6, λ=5 to 1 (400%), and d, M and A are variable. The coiled fiber loops are not rotated about the central axis by the rotating rollers or spindles. Take-up speed of 500 m/min is typical take-up speed for the commercial process for tape yarns and monofilaments.

(b) The Case of the Embodiment of FIG. 5A with the Coiled Serpentine Fiber Loops.

Equations (10)-(32) derived for the case of the coiled equilateral polygonal fiber loops (embodiments of FIGS. 1A-4A) are applicable for the case of the embodiment of FIG. 5A with the serpentine fiber loops where a number of the conveyer-drawing members n=2.

EXAMPLE 3

Table III gives the results of calculations for the case: L=5500 mm, $V_{outlet}=V_{take\text{-}up}$==2000 m/min (the fiber is conveyed to the receiving package after the drawing stage), n=2, λ=5 to 1 (400%), and d, M and A are variable. Fiber points of the serpentine fiber loops are not moved by rotating rollers along the fiber axis. As discussed above, this embodiment of the invention having the serpentine fiber loops can draw multiple ends.

Thus, in the cases examined in Examples 1-3, fiber linear speed $(V_{fiber})_{max}$ is low, i.e., 0.1-8 m/min, time of drawing T can reach tens of seconds, strain rate $V_{strain}$ is low, i.e., 6-70%/sec, and the ratio of $V_{outlet}$ to $(V_{fiber})_{max}$ is greater than 1 to 1, i.e., varying from the ratio 250 to 1 to the ratio 9000 to 1 (the fiber drawing apparatus can be constructed and arranged to provide the ratio, if necessary, lower than 250 to 1 and greater than 9000 to 1). In case of conventional commercial drawing process having the same λ=400% and $(V_{fiber})_{max}=V_{fiber2}=V_{outlet}=V_{take\text{-}up}$=3000 m/min., time of drawing T is about 1 second, and $V_{strain}$ is substantially higher, i.e., about 400%/sec.

In the invented method, time of drawing T in some cases is so long that it can be decreased by a factor of 1.5-2 remaining sufficiently long (20-40 sec) to perform uniform hot drawing of even high denier fibers. Thus, speeds $V_{loop}$, $V_{outlet}$, and $V_{take\text{-}up}$ can be also increased in these cases at least by a factor of 1.5-2, resulting in the 1.5-2-fold increase and more of the throughput. Thus, the take-up speed can be 4500-6000 m/min and more.

TABLE I

Results of Calculations for Example 1.

| | Length of the fiber coil along the central axis M, mm | Pitch of the fiber coil d, mm | A = $V_{outlet}/V_{loop}$ = $V_{take\text{-}up}/V_{loop}$ = L/d | Fiber loop speed $V_{loop}$ = 3000/A, m/min | Time of drawing T = M/$V_{loop}$, sec*) | Number of loops in the heat chamber, N = M/d | Linear fiber speed in the drawing process $(V_{fiber})_{max}$, m/min*) | B = $V_{outlet}/(V_{fiber})_{max}$ = $V_{take\text{-}up}/(V_{fiber})_{max}$ = 3000/$(V_{fiber})_{max}$ | Strain rate $V_{strain}$ = λ/T = 400/T, %/sec*) | Divergence angle α for draw ratio λ 5 to 1, deg.**) |
|---|---|---|---|---|---|---|---|---|---|---|
| 1 | 500 | 5 | 1100 | 2.7 | 11.1 | 100 | 2.0 | 1500 | 36 | 55.7 |
| 2 | 500 | 7.5 | 733 | 4.1 | 7.3 | 67 | 3.0 | 1000 | 54.8 | 55.7 |
| 3 | 500 | 10 | 550 | 5.4 | 5.6 | 50 | 4.0 | 750 | 72 | 55.7 |

TABLE I-continued

Results of Calculations for Example 1.

| | Length of the fiber coil along the central axis M, mm | Pitch of the fiber coil d, mm | A = $V_{outlet}/V_{loop}$ = $V_{take-up}/V_{loop}$ = L/d | Fiber loop speed $V_{loop}$ = 3000/A, m/min | Time of drawing T = $M/V_{loop}$, sec*) | Number of loops in the heat chamber, N = M/d | Linear fiber speed in the drawing process $(V_{fiber})_{max}$, m/min*) | B = $V_{outlet}/(V_{fiber})_{max}$ = $V_{take-up}/(V_{fiber})_{max}$ = 3000/$(V_{fiber})_{max}$ | Strain rate $V_{strain}$ = λ/T = 400/T, %/sec*) | Divergence angle α for draw ratio λ 5 to 1, deg.**) |
|---|---|---|---|---|---|---|---|---|---|---|
| 4 | 1000 | 5 | 1100 | 2.7 | 22.2 | 200 | 1.0 | 3000 | 18 | 36.3 |
| 5 | 1000 | 7.5 | 733 | 4.1 | 14.6 | 134 | 1.5 | 2000 | 27.4 | 36.3 |
| 6 | 1000 | 10 | 550 | 5.4 | 11.1 | 100 | 2.0 | 1500 | 36 | 36.3 |
| 7 | 2000 | 5 | 1100 | 2.7 | 44.4 | 400 | 0.5 | 6000 | 9 | 20.1 |
| 8 | 2000 | 7.5 | 733 | 4.1 | 29.2 | 268 | 0.75 | 4000 | 13.7 | 20.1 |
| 9 | 2000 | 10 | 550 | 5.4 | 22.2 | 200 | 1.0 | 3000 | 18 | 20.1 |
| 10 | 3000 | 5 | 1100 | 2.7 | 66.6 | 600 | 0.34 | 8956 | 6 | 13.7 |
| 11 | 3000 | 7.5 | 733 | 4.1 | 43.8 | 400 | 0.5 | 6000 | 9 | 13.7 |
| 12 | 3000 | 10 | 550 | 5.4 | 33.3 | 300 | 0.65 | 4512 | 12 | 13.7 |

*)In case of the fiber coil rotation about the central axis, T and $V_{strain}$ need to be corrected according to equations (29) and (5) respectively.
**)In case of the embodiment with the conveyer-drawing chains consisting of several sections (FIG. 2A), all chain sections have the same divergence angle α.

TABLE II

Results of Calculations for Example 2.

| | Length of the fiber coil along the central axis M, mm | Pitch of the fiber coil d, mm | A = $V_{outlet}/V_{loop}$ = $V_{take-up}/V_{loop}$ = L/d | Fiber loop speed $V_{loop}$ = 500/A, m/min | Time of drawing T = $M/V_{loop}$, sec*) | Number of loops in the heat chamber, N = M/d | Linear fiber speed in the drawing process $(V_{fiber})_{max}$, m/min*) | B = $V_{outlet}/(V_{fiber})_{max}$ = $V_{take-up}/(V_{fiber})_{max}$ = 500/$(V_{fiber})_{max}$ | Strain rate $V_{strain}$ = λ/T = 400/T, %/sec*) | Divergence angle α for draw ratio λ 5 to 1, deg.**) |
|---|---|---|---|---|---|---|---|---|---|---|
| 1 | 500 | 5 | 400 | 1.25 | 24 | 100 | 0.34 | 1492 | 16.7 | 28.1 |
| 2 | 500 | 7.5 | 267 | 1.87 | 16 | 67 | 0.50 | 1000 | 25 | 28.1 |
| 3 | 500 | 10 | 200 | 2.5 | 12 | 50 | 0.67 | 746 | 33.3 | 28.1 |
| 4 | 1000 | 5 | 400 | 1.25 | 48 | 200 | 0.17 | 3030 | 8.3 | 14.9 |
| 5 | 1000 | 7.5 | 267 | 1.87 | 32 | 134 | 0.25 | 2000 | 12.5 | 14.9 |
| 6 | 1000 | 10 | 200 | 2.5 | 24 | 100 | 0.34 | 1492 | 16.7 | 14.9 |
| 7 | 1500 | 5 | 400 | 1.25 | 72 | 300 | 0.11 | 4546 | 5.6 | 10.1 |
| 8 | 1500 | 7.5 | 267 | 1.87 | 48 | 200 | 0.17 | 3030 | 8.3 | 10.1 |
| 9 | 1500 | 10 | 200 | 2.5 | 36 | 150 | 0.22 | 2222 | 11.1 | 10.1 |

*)In case of the fiber coil rotation about the central axis, T and $V_{strain}$ need to be corrected according to equations (29) and (5) respectively.
**)In case of the embodiment with the conveyer-drawing chains consisting of several sections (FIG. 2A), all chain sections have the same divergence angle α.

TABLE III

Results of Calculations for Example 3.

| | Length of the fiber serpentine along the central axis M, mm | Pitch of the fiber serpentine d, mm | A = $V_{outlet}/V_{loop}$ = $V_{take-up}/V_{loop}$ = L/d | Fiber loop speed $V_{loop}$ = 2000/A, m/min | Time of drawing T = $M/V_{loop}$, sec*) | Number of loops in the heat chamber, N = M/d | Linear fiber speed in the drawing process $(V_{fiber})_{max}$, m/min*) | B = $V_{outlet}/(V_{fiber})_{max}$ = $V_{take-up}/(V_{fiber})_{max}$ = 2000/$(V_{fiber})_{max}$ | Strain rate $V_{strain}$ = λ/T = 400/T, %/sec*) | Divergence angle α for draw ratio λ 5 to 1, deg. |
|---|---|---|---|---|---|---|---|---|---|---|
| 1 | 2000 | 20 | 275 | 7.3 | 16.4 | 100 | 4.0 | 500 | 24.4 | 28.8 |
| 2 | 2000 | 30 | 183 | 10.9 | 11.0 | 67 | 6.0 | 333 | 36.4 | 28.8 |
| 3 | 2000 | 40 | 138 | 14.5 | 8.3 | 50 | 8.0 | 250 | 48.2 | 28.8 |
| 1 | 3000 | 20 | 275 | 7.3 | 24.6 | 150 | 2.6 | 769 | 16.3 | 20.1 |
| 2 | 3000 | 30 | 183 | 10.9 | 16.5 | 100 | 4.0 | 500 | 24.2 | 20.1 |
| 3 | 3000 | 40 | 138 | 14.5 | 12.4 | 75 | 5.3 | 377 | 32.2 | 20.1 |
| 4 | 4000 | 20 | 275 | 7.3 | 32.8 | 200 | 2.0 | 1000 | 12.2 | 15.4 |
| 5 | 4000 | 30 | 183 | 10.9 | 22.0 | 134 | 3.0 | 667 | 18.2 | 15.4 |

TABLE III-continued

Results of Calculations for Example 3.

| | Length of the fiber serpentine along the central axis M, mm | Pitch of the fiber serpentine d, mm | A = $V_{outlet}/V_{loop}$ = $V_{take-up}/V_{loop}$ = L/d | Fiber loop speed $V_{loop}$ = 2000/A, m/min | Time of drawing T = $M/V_{loop}$, sec*) | Number of loops in the heat chamber, N = M/d | Linear fiber speed in the drawing process $(V_{fiber})_{max}$, m/min*) | B = $V_{outlet}/(V_{fiber})_{max}$ = $V_{take-up}/(V_{fiber})_{max}$ = 2000/$(V_{fiber})_{max}$ | Strain rate $V_{strain}$ = λ/T = 400/T, %/sec*) | Divergence angle α for draw ratio λ 5 to 1, deg. |
|---|---|---|---|---|---|---|---|---|---|---|
| 6 | 4000 | 40 | 138 | 14.5 | 16.6 | 100 | 4.0 | 500 | 24.1 | 15.4 |
| 7 | 5000 | 20 | 275 | 7.3 | 41.0 | 400 | 1.6 | 1250 | 9.8 | 12.4 |
| 8 | 5000 | 30 | 183 | 10.9 | 27.5 | 268 | 2.4 | 833 | 14.5 | 12.4 |
| 9 | 5000 | 40 | 138 | 14.5 | 20.8 | 200 | 3.2 | 625 | 19.2 | 12.4 |
| 10 | 6000 | 20 | 275 | 7.3 | 49.2 | 300 | 1.3 | 1538 | 8.1 | 10.4 |
| 11 | 6000 | 30 | 183 | 10.9 | 33.0 | 200 | 2.0 | 1000 | 12.1 | 10.4 |
| 12 | 6000 | 40 | 138 | 14.5 | 24.8 | 150 | 3.2 | 625 | 16.1 | 10.4 |

*)In case of the fiber coil movement by the rotated rollers, T and $V_{strain}$ need to be corrected according to equations (29) and (5) respectively.

Experiment—Drawing of Polypropylene Fibers.

The first version of a prototype of the drawing apparatus was built. The drawing apparatus comprises two endless chains as the conveyer-drawing members, non-driven, free-to-rotate rollers as the guide members of the displacing elements, and a heat chamber supplied with hot air. The feed and take-off devices or mechanisms were not built at this first stage. However, this type of mechanisms was proved to be feasible and was successively used in the industrial processes for heat setting of polymer fibers discussed above. The heat chamber of this unit was 1000 mm. long.

Polypropylene commercial resin from Amoco Chemical Co. (grade 10-6345) was used. The resin had the following parameters: Melt Flow Rate –3.1 gm/10 min., $M_w$=370,000, and MWD=5.6. It was extruded at 220° C. through the 0.5 mm spinneret orifice at very low take-up speed and quenched in a water bath at room temperature. Wide-angle X-ray diffraction pattern revealed that the as-spun fiber produced was unoriented and low-crystalline.

The drawing process was performed in two separate stages using the drawing apparatus twice, at different temperatures. These two stages of drawing represent two different drawing mechanisms occurring on the molecular level. The initial drawing stage converts the undrawn spherulitic as-spun fiber into a fiber with fibrillar structure developed through a necking-down mechanism. The first stage can be rapid. It is followed by the second drawing stage, which is named superdraw. The second drawing stage orients the newly formed fibrillar structure. This stage needs to be much slower to produce polymer fibers with improved physical properties approaching those achieved in lab-scale experiments mentioned above (V. A. Marikhin and L. P. Myasnikova, "Nadmolekulyarnaya Struktura Polymerov", St. Petersburg, Russia, Khimia (1977); V. A. Marikhin and L. P. Myasnikova, Progr. Colloid Polym. Sci., 92, 39-51 (1993); W. N. Taylor and E. S. Clark, Polym. Eng. Sci., 18, 518-526 (1978)). The first stage can be performed by both conventional and the invented drawing methods. The slower second stage needs to be performed by the invented method and apparatus.

The heat chamber was preheated to given drawing temperatures (see Tables IV and V below) with the chains at rest. The front door of the chamber was opened, several loops of polypropylene fibers were placed about the receiving ends of the chains and supported by the rollers inside the heat chamber, the chamber door was closed, and temperature was raised to given temperatures for 30-300 seconds (see Tables IV and V). Then the driving electrical motor was turned on, and the chains started to move conveying the fiber loops through the heat chamber and simultaneously drawing the fiber. When the fiber reached the delivery ends of the chains, the equipment was stopped, the chamber door was opened, and the drawn fiber was cooled down for 20-300 seconds (see Tables IV and V) before being removed.

Tensile properties were measured by an Instron tensile-testing machine. The breaking length was 30 mm, and the lower clamp speed was 50 mm/min. Results can be seen in Table VI along with results on shinkage. Each result is an average of three tests. Results for conventional commercial polypropylene fibers are presented for comparison.

Thus the results of the first experiments confirm that the invented method is capable of producing industrial polymer fibers with superior physical properties in comparison with the conventional industrial processes and approaching those generated in the lab-scale experiments. Our results are very close to laboratory results reported in paper of Taylor and Clark (see Table VI) for regular-molecular-weight polypropylene fibers, i.e., our samples have tenacity 0.9-1.2 GPa (11-14.5 gpd) and tensile initial modulus 17.7-20.5 GPa (214-248 gpd).

TABLE IV

Drawing Conditions for Polypropylene Fibers, First Stage of Drawing

| | $T_1$, sec | $t_1$, ° C. | $T_2$, sec | $t_2$, ° C. | $T_3$, s sec | $\lambda_1$ | $(V_{fiber})_{max1}$, m/min | $V_{strain1}$, %/sec |
|---|---|---|---|---|---|---|---|---|
| 1 | 120 | 80 | 52 | 80 | 20 | 7.6 | 0.24 | 12.7 |
| 2 | 100 | 80 | 50 | 80 | 20 | 7.1 | 0.25 | 12.2 |
| 3 | 130 | 80 | 56 | 80 | 20 | 7.7 | 0.22 | 12.0 |
| 4 | 120 | 80 | 52 | 80 | 20 | 7.1 | 0.24 | 11.7 |
| 5 | 110 | 80 | 58 | 80 | 20 | 7.7 | 0.22 | 11.5 |
| 6 | 120 | 80 | 54 | 80 | 20 | 7.7 | 0.23 | 12.4 |

$t_1$ - beginning drawing temperature of the first drawing stage
$t_2$ - final drawing temperature of the first drawing stage
$\lambda_1$ - draw ratio for the first drawing stage
$T_1$ - time of heating the chamber, with the fiber and chains at rest, to temperature $t_1$
$T_2$ - time of drawing the fiber
$T_3$ - time if cooling drawn fiber with the fiber and chains at rest and the chamber door open
$(V_{fiber})_{max1}$ - the highest value of fiber speed $V_{fiber}$ at the first drawing stage
$V_{strain1}$ - fiber strain rate at the first drawing stage

TABLE V

Drawing Conditions for Polypropylene Fibers, Second Stage of Drawing

| | $T_4$, sec | $t_3$, ° C. | $T_5$, sec | $t_4$, ° C. | $T_6$, sec | $\lambda_2$ | $(V_{fiber})_{max2}$, m/min | $V_{strain2}$, %/sec | $\lambda = \lambda_1 \times \lambda_2$ |
|---|---|---|---|---|---|---|---|---|---|
| 1 | 240 | 140 | 168 | 140 | 30 | 2.6 | 0.03 | 0.9 | 19.8 |
| 2 | 300 | 140 | 160 | 140 | 30 | 2.6 | 0.03 | 1.0 | 18.5 |
| 3 | 280 | 155 | 185 | 155 | 30 | 2.7 | 0.02 | 1.1 | 20.8 |
| 4 | 30 | 135 | 30 | 142 | 300 | 2.3 | 0.15 | 4.3 | 16.3 |
| 5 | 40 | 130 | 80 | 139 | 240 | 2.4 | 0.58 | 1.8 | 18.5 |
| 6 | 50 | 133 | 90 | 143 | 240 | 2.5 | 0.50 | 1.7 | 19.2 |

$t_3$ - beginning drawing temperature of the second drawing stage
$t_4$ - final drawing temperature of the second drawing stage
$\lambda_2$ - draw ratio for the second drawing stage
$T_4$ - time of heating the chamber, with the fiber and chains at rest, to temperature $t_3$
$T_5$ - time of drawing the fiber in the temperature range from $t_3$ to $t_4$
$T_6$ - time of cooling drawn fiber with the fiber and chains at rest the chamber door open
$(V_{fiber})_{max2}$ - the highest value of fiber speed $V_{fiber}$ at the second drawing stage
$V_{strain2}$ - fiber strain rate at the second drawing stage
$\lambda$ - total draw ratio

TABLE VI

Physical Properties of Polypropylene (PP) Fibers

| | Tenacity, GPa, (gpd) | Tensile Initial Modulus, GPa, (gpd) | Breaking Elongation, % | Hot-Air Shrinkage at 132° C. % |
|---|---|---|---|---|
| 1 | 1.2 (14.5) | 19.2 (232) | 8.0 | 0 |
| 2 | 0.9 (10.9) | 19.1 (231) | 6.6 | 0 |
| 3 | 0.9 (10.9) | 20.5 (248) | 7.6 | 0 |
| 4 | 1.1 (13.3) | 17.8 (215) | 10.2 | 3 |
| 5 | 0.9 (10.9) | 17.7 (214) | 7.6 | 2 |
| 6 | 1.05 (12.7) | 18.9 (229) | 9.7 | 2 |
| Commercial PP fibers (Herculon, Marvess) | 0.4-0.7*) (5-9) | 2.4-3.7*) (29-45) | 15-30*) | 2-10**) |
| Lab-scale PP fibers***) | 0.93 (11.2) | 22 (266) | 6.2 | — |

*)Encyclopedia Britannica 2001 (http://www.britannica.com/eb/article?eu=126288), "Properties and Applications of Prominent Man-Made Fibres".
**)Low values of the shrinkage could be a result of fiber relaxation or heat setting after the drawing discussed above.
***)W. N. Taylor and E. S. Clark, Polym. Eng. Sci., 18, 518-526 (1978). PP resin: $M_w$ = 277,000, MWD = 10. Heating medium - silicon oil. First drawing stage: initial length - 100 mm, $V_{fiber1}$ = 1 m/min, $V_{strain1}$ = 16.7%/sec, $t_2$ = 130° C. Second drawing stage: $V_{fiber2}$ = 0.001 m/min, $V_{strain2}$ = 0.07%/sec, $t_4$ = 130° C., total $\lambda$ = 25.

As presented in Tale VI, for polypropylene fibers tenacity is increased by a factor of 1.2-3.0, initial modulus is increased by a factor of 4.8-8.5, and breaking elongation is decreased by a factor of 1.54 in comparison with conventional industrial processes. This is accompanied by excellent dimensional stability, i.e., hot-air shrinkage is 0-3% at 132° C.

Figure 8:
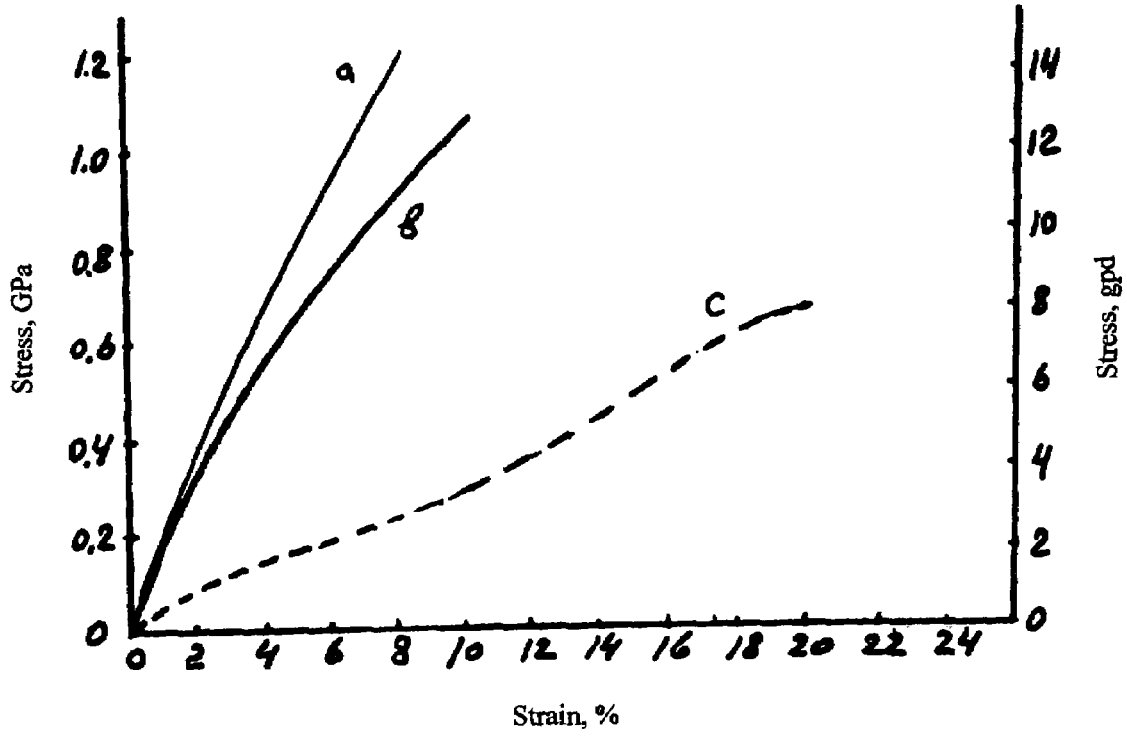
FIG. 8 shows stress-strain behavior of polypropylene fibers drawn by the invented method: a—sample 1, b—sample 4 from Tables IV-VI, c—conventional commercial technology.

As an example, stress-strain behavior of the samples 1 and 4 from Tables IV-VI is presented in FIG. 8. In contrast to many commercial polypropylene fibers (FIG. 8, curve c), the stress-strain curves do not have the yielding part or plateau, that indicates high intermediate moduli and, probably, low creep.

ADVANTAGES

From the descriptions, calculations, and results of experiments given above, one or more of following advantages of the invented drawing method and apparatus in comparison with the prior art in industrial fiber drawing processes become evident:

1. The invented method and apparatus provide the fiber drawing in industrial environment at low fiber speed $V_{fiber}$ and, at the same time, maintain fiber outlet speed $V_{outlet}$ and fiber take-up speed $V_{take\text{-}up}$ up to 3000-6000 m/min and more providing high throughput. The ratio of speed $V_{outlet}$ to speed $(V_{fiber})_{max}$ is greater than 1 to 1 ranging from about 10 to 1 to about 9000 to 1. This accomplishment results in some other advantages presented below.

2. The invented method and apparatus provide the uniform fiber drawing in industrial high-throughput process at low strain rate $V_{strain}$, i.e., about 6-70%/sec, and high drawing time T, i.e., it can reach tens of seconds. This long drawing time is necessary to heat the fiber to the elevated ambient temperature with low temperature gradient in the fiber cross-section during the drawing in order to have uniform morphology and physical properties in the cross-section.

3. The low-strain-rate, long-drawing-time invented method and apparatus provide more reliable high-throughput industrial process for continuous uniform drawing of polymer fibers without abrupt, "impulsive" acceleration resulting in lower tension in the drawing line, less breaks, less equipment stops, and less waste than in the prior art.

4. The invented method and apparatus for continuous fiber drawing provide high-throughput industrial process producing dimensionally stable, low-shrinkage fibers without using expensive and energy-consuming additional equipment while retaining enhanced physical properties, such as initial modulus, intermediate moduli, and tenacity, mentioned above. This may result in substantial saving of capital expenses, energy consumption, and possibility of smaller industrial space.

5. The invented method and apparatus provide high-throughput industrial continuous process for drawing of polymer fiber (both flexible-chain and wholly-aromatic) capable of improving their tensile properties (i.e., tenacity, Young modulus, intermediate moduli, etc.) approaching those obtained in laboratory experiments. This method is the missing link in development of a new generation of low-cost, high-performance industrial polymer fibers (most probably made of melt-spun, regular-molecular-weight polyester, nylon, polypropylene, polyethylene, and other flexible-chain polymers) having tenacity of about 1-2 GPa (12-22 gpd) and initial tensile modulus of about 20-100 GPa (250-1000 gpd) for different polymer fibers having different theoretical values of tensile properties. Thus, for the new generation of industrial melt-spun, flexible-chain polymer fibers, tenacity can be 1.5-2.0 times higher and initial moduli can be several times higher than for conventional commercial flexible-chain polymer fibers.

6. Our invention can accomplish all of the above because it overcomes limitations and operational problems of Sordelli discussed above in section BACKGROUND OF THE INVENTION. The invented method and apparatus have advantages in comparison with Sordelli as follows:

(a) In the invented drawing apparatus the conveyer-drawing structure is stronger (because the conveyer-drawing members are not cantilever but two-side supported and not skewed) and can generate and sustain higher drawing forces while conveying and simultaneously drawing larger number of the fiber loops. Tables I and III (lines 10-12) present cases with number of the fiber loops from 150 to 600.

(b) For the same reasons, the conveyer-drawing structure can be longer to place the larger number of the fiber loops. Tables I and III (lines 10-12) present cases with length of the fiber coil along the central axis 3000 mm and 6000 mm.

(c) In the invented drawing apparatus, the conveyer-drawing structure can provide larger diameter and circumference of the leading fiber loop at the delivery ends and higher draw ratios, as it can have the divergence angle for the conveyer-drawing members and their length as large as necessary. Examples 1 and 3 and Tables I, III, and IV present cases for 5× and 7.7× draw ratios, 5500 mm circumference of the leading fiber loop, and the divergence angle from 10 to 56 degrees.

(d) In the invented drawing apparatus, the conveyer-drawing structure can provide higher outlet speed $V_{outlet}$ of the drawing apparatus as it can provide larger number of the fiber loops and larger diameter and circumference of the leading fiber loop (see above). Speed $V_{outlet}$ is proportional to number of the fiber loops inside of the drawing apparatus and the diameter (or circumference) of the leading fiber loop [equations (32) and (34)]. Examples 1 and 3 present cases with the outlet speed 2000 m/min and 3000 m/min, and last paragraph of page 35 states that outlet speed can be 4500-6000 m/min and more.

(e) In the invented drawing apparatus, the fiber displacing members improve operational capability of the drawing apparatus which is more reliable, i.e. because (1) the fiber-displacing members support the fiber loops, the loops cannot slide down along conveyer-drawing members at any circumstances including: (i) high degree of divergency of the conveyer-drawing members necessary for higher draw ratios, (ii) some polymers with lower friction coefficient, and (iii) some finishes applied in the fiber making process and (2) the conveyer-drawing members can operate at elevated temperatures inside of a heat chamber as they do not need covers made of rubber or other materials to improve friction for preventing sliding down of the fiber loops in case of smooth-surface members.

(f) Our invention provides a capability to draw parallel multiple fiber ends (pages 26-29). This new feature increases throughput of the fiber making process and is important for manufacturing low-cost industrial fibers.

(g) The invented drawing apparatus with the endless circulating conveyer-drawing members (chains, cables, belts, bands, cords, and escalator-type moving stairs) is operator-friendly (pages 25, last paragraph) that is, in case of fiber breakage the members convey the broken fiber ends to the delivery ends where an operator can easily handle them.

CONCLUSION, RAMIFICATIONS, AND SCOPE

Thus, the reader can see that the fiber drawing method and apparatus of this invention can be used to produce industrial fibers at fiber speed $(V_{fiber})_{max}$ substantially lower than outlet speed $V_{outlet}$ and take-up speed $V_{take\text{-}up}$ and at substantially lower strain rate $V_{strain}$, lower tension in the fiber drawing line, and longer drawing time T than in the prior art without reducing throughput.

This provides a basis for achieving some unprecedented results, i.e., producing industrially polymer fibers with improved tensile and other physical properties approaching those obtained in laboratory experiments. This means that the development of a new generation of low-cost, high-performance, flexible-chain industrial polymer fibers is feasible. On the one hand, tenacity of the new fibers can be ⅓-½ of that of high-cost, high-strength, high-modulus fibers (Kevlar 49®, Twaron®, Spectra®, Dyneema®, et al.) discussed above. On the other hand, the tenacity can be one and a half times and more higher than that of low-cost, low-performance commercial flexible-chain polymer fibers. Initial modulus and intermediate moduli can be increased even greater.

Furthermore, this invented method offers additional advantages.

The invented method resolves another fundamental problem of the fiber technology—how to produce industrial fibers having substantially improved both tensile properties and dimensional stability (low shrinkage) in the high-throughput process without utilizing special heat-setting equipment. This may result in substantial saving in capital expenses, and possibility of a smaller industrial space.

It also provides a more reliable process, which has fewer breaks and equipment stops, and lower waste resulting in substantial saving.

While the above description contains many specifics, these should not be considered as limitations on the scope of the invention, but rather as an exemplification of the presented embodiments thereof. Many other variations are possible. For example:

1. In the embodiments of FIGS. 1A-3A, the winding and unwinding flyers are located outside the heat chamber, while the heat chamber surrounds the greatest part of the conveyer-drawing members.

2. The invented drawing apparatuses can be arranged in a series or other treating devices may be provided between two drawing apparatuses of the invention; a consecutive arrangement of two or more invented apparatuses is especially advantageous for achieving the total draw ratios 10 to 1 and higher, like in case of gel spinning of ultra-high molecular weight polymers, or providing different drawing temperatures at different stages of drawing.

3. A conventional stage of drawing using cylindrical draw rollers may precede or follow the invented apparatus; the rollers can be used for fine and minute adjustment of the total draw ratio; the draw rollers can be constructed with or without internal heaters.

4. In the embodiment illustrated in FIG. 1A each spindle is replaced by several consecutive rotating spindles connected by universal joints and arranged either at different or same divergence angles $\alpha$.

5. In another embodiment of the invention, each conveyer-drawing member (e.g., the threaded spindle or the chain) consists of three sections. In section I the conveyer-drawing members are arranged in parallel to the central axis, in section II they diverge from the central axis (as in the embodiments illustrated in FIGS. 1A-4A), and in section III they are arranged in parallel to the central axis again. Sections I and III are outside the heat chamber, their transfer points with section II being arranged right before and right after the heat chamber respectively. Section II is predominantly inside the heat chamber (at least 85% of its path is inside the chamber). That prevents the temperature of the conveyer-drawing members in section II from falling substantially below the temperature of the heat chamber when they leave the chamber. The fiber is wound in successive fiber loops about the conveyer-drawing members by the fiber-winding device in the beginning of section I, moved along sections I-III, and unwound at the end of section III by the unwinding device. In this arrangement the fiber enters the heat chamber in the form of coiled loops and cools down in the form of coiled loops after the heat chamber. The conveyer-drawing members in section II could be subdivided into two or more sections, which are arranged consecutively at transfer points.

6. In the embodiment of FIG. 1A, the threaded spindles are conical with diameter increased towards the delivery ends. Each point of the fiber loops rotates about the central axis with increasing linear speed while moving from the receiving to delivery ends. Optimization of this effect can result in better uniformity of the drawn fiber.

7. In the embodiments of FIGS. 1A-4A, a stepping electric motor is used to drive the conveyer-drawing members (the threaded spindles, endless chains, etc.), the winding flyer, and the unwinding flyer.

8. In another embodiment of the invention, the conveyer-drawing members are cantilever having either the delivery or receiving ends free, with no support. This is an alternative design to the embodiments of FIGS. 1A-3A having some advantages in taking the fiber off the apparatus or feeding the fiber to the apparatus. In case of the cantilever conveyer-drawing members having free delivery ends, the leading fiber loop can be taken off from the delivery ends by the take-off mechanism without the unwinding flyer.

9. In the embodiment of FIG. 1A, some of the threaded spindles rotate in a direction opposite to the direction of rotation of the other spindles. Oppositely, rotating spindles have opposite threads. For example, the spindles rotating in one direction have right hand thread and the spindles rotating in the opposite direction have left hand thread. Consequently, all spindles transport the fiber thereon in the same direction, but since opposite forces are exerted by oppositely rotating threaded spindles in circumferential direction on the fiber, the coiled fiber loops are not rotated about the central axis.

10. In the embodiment of FIG. 3A rollers 98 have tracer pins attached to their lateral surfaces instead of gears 100. These pins slide along specially profiled stationary slots, while rollers 98 are moved from the receiving to delivery ends, and turn rollers 98. Therefore, gears 84, 86, and 90 and shaft 88 are not installed.

11. In the embodiments of FIGS. 2A-4A, circulating endless cables, belts, bands, cords, or escalator-type moving stairs can be used as the conveyer-drawing members instead of the chains.

12. In the embodiments of FIGS. 2A-4A, the displacing members comprise guide plates, rods or pins mounted on the chains, cables, belts, bands, cords, or escalator-type moving stairs instead of the rollers and the guide semi-rings.

13. The fiber draw ratio can be changed, in addition to that presented in the embodiments of FIGS. 1A-4A, by changing positions along the central axis where the fiber is received on the conveyer-drawing members and/or taken off from the conveyer-drawing members, circumferences of the first fiber loop at the receiving ends and/or the leading fiber loop at the delivery ends being changed respectively.

14. The fiber draw ratio can be changed, in addition to that presented in the embodiments of FIGS. 1A-4A, by adjusting the distance between the delivery ends and the central axis, circumference of the leading fiber loop being changed.

15. In the embodiments of FIGS. 1A-3A, the fiber can be treated, while being drawn, using hot plates or baths of active media instead oh the heat chambers.

16. In the embodiment of FIGS. 3A and 4A, each conveyer-drawing member is one rotating endless chain instead of a pair of parallel ones.

17. In the embodiment of FIG. 5A having the serpentine loops, the fiber draw ratio can be changed by the same way as for the embodiments of FIGS. 1A-4A, i.e., (a) by adjusting the distance between either the receiving ends or delivery ends of the conveyer-drawing members and the central axis and (b) by changing positions along the central axis where the fiber is received on the conveyer-drawing members and/or taken off from the conveyer-drawing members.

18. In the embodiment of FIG. 5A having the serpentine loops, flyer 132 of the feed device and flyer 132' of the take-off device move up and down along guides 134 and 134' respectively by means of electric motors rather than to be struck by plungers 138 and 138'.

19. In the embodiments of FIGS. 3A and 4A, the apparatus can draw multiple fiber ends either in the form of a bundle or in the form of a few parallel ends supported by rollers 98 having a few circular parallel grooves.

Accordingly, the scope of the invention should be determined not by the embodiments illustrated, but by the appended claims and their legal equivalents.

APPENDIX

| Designations for symbols | |
|---|---|
| $\lambda$ | Draw ratio, i.e., the extent of the fiber drawing |
| $V_{fiber}$ | Linear speed along the fiber axis of fiber points in the process of drawing; in the invented drawing apparatus the speed is different for different fiber points of each fiber section being drawn between two adjacent conveyer-drawing members |
| $V_{fiber1}$ | Speed $V_{fiber}$ in the beginning of the fiber drawing |
| $V_{fiber2}$ | Speed $V_{fiber}$ at the end of the fiber drawing |
| $V_{surface1}$ | Linear surface speed of the feed rollers (in case of conventional drawing by rotating rollers) |
| $V_{surface2}$ | Linear surface speed of the receiving rollers (in case of conventional drawing by rotating rollers) |
| $(V_{fiber})_{max}$ | The highest value of fiber speed $V_{fiber}$ in the drawing process |
| $V_{fiberK}$ and $V_{fiberP}$ | Speed $V_{fiber}$ of fiber points K and P (FIG. 6B) in the invented drawing apparatus |
| $V_{inlet}$ | Fiber inlet speed, which is a fiber linear speed along the fiber axis of feeding the fiber to the drawing apparatus |

APPENDIX-continued

| Designations for symbols | |
|---|---|
| $V_{outlet}$ | Fiber outlet speed, which is a fiber linear speed along the fiber axis of conveying the drawn fiber from the drawing stage either to the next stage of the continuous fiber making process or to the receiving package. |
| $V_{take\text{-}up}$ | Take-up speed, which is a fiber linear speed along the fiber axis of taking-up the drawn fiber on the receiving package |
| $V_{strain}$ | Strain rate, which is a relative deformation of the fiber (strain) in a unit time |
| T | Time of drawing |
| $V_{loop}$ | Speed of conveying of the fiber loops along the central axis |
| d | Distance between adjacent loops in the fiber coil along the central axis, i.e., a pitch of the fiber coil |
| ΔT | Time needed for the fiber loop to pass distance d |
| L | Circumference of the leading fiber loop at the delivery ends |
| L' | Circumference of the first fiber loop at the receiving ends |
| n | Number of the conveyer-drawing members |
| A | Ratio $V_{outlet}/V_{loop}$ ($V_{take\text{-}up}/V_{loop}$ where $V_{outlet} = V_{take\text{-}up}$) |
| B | Ratio $V_{outlet}/(V_{fiber})_{max}$ |
| α | Divergence angle -- angle between the conveyer-drawing members and the central axis of the apparatus |
| $L_{fiber}$ | Distance, which each point of the fiber loop passes in the process of rotation of the loop by the rotating rollers or spindles about the central axis while the loop as a whole passes distance d along the central axis for time ΔT |
| $L_{total}$ | Total distance, which each point of the fiber loop passes in the process of rotation of the loop by the rotating spindles or rollers about the central axis while the loop as a whole passes from the receiving up to delivery ends |
| $L_{average}$ | Average circumference of the fiber loops in the heat chamber |
| $L_i$ and $L_{i+1}$ | Circumferences of two adjacent fiber loops |
| N | Number of the fiber loops in the heat chamber |
| N' | Number of the fiber loops with the average circumference $L_{average}$, which have the total circumference equals $L_{total}$. (it is a reduction in number of the fiber loops passing the heat chamber for time of drawing T as a result of rotation of the loops about the central axis relative to the case with no rotation) |
| M | Length of the fiber coil along the central axis |
| $V_{rotation}$ | Fiber linear speed of each point of the fiber loop in case of rotation of the coiled fiber loops by the rotating rollers or spindles about the central axis; it equals the linear surface speed of these rollers or spindles |

The invention claimed is:

1. A process of continuously drawing fibers comprising:

(a) feeding the fiber at an inlet speed to an apparatus for fiber drawing, (b) providing the fiber drawing apparatus, which comprises a conveyer-drawing structure comprising at least two conveyer-drawing members for conveying and simultaneous drawing of the fiber, wherein the conveyer-drawing members are disposed about a central axis, which is parallel to a direction of conveying, and have receiving ends for receiving the fiber and delivery ends for delivering the fiber, and both the receiving and delivery ends are spaced along the central axis, wherein the delivery ends are spaced further from the central axis than the receiving ends, (c) laying the fiber continuously into coiled loops on the receiving ends of the conveyer-drawing members, (d) drawing the fiber at a draw temperature and speed by expanding a circumference of the fiber loops while conveying the fiber loops along the central axis from the receiving ends to the delivery ends by the conveyer-drawing members, a layer comprising the coiled fiber loops being formed on the conveyer-drawing members, (e) taking off continuously the leading fiber loops from the delivery ends of the conveyer-drawing members, and (f) conveying the drawn fiber from the fiber drawing apparatus at an outlet speed $V_{outlet}$, wherein a ratio of fiber outlet speed $V_{outlet}$ to a fiber speed $(V_{fiber})_{max}$ is greater than 1 to 1, fiber speed $(V_{fiber})_{max}$ being the highest value of a linear speed of fiber points along the fiber axis in the process of drawing, wherein the conveyer-drawing members have both the receiving and delivers ends supported, wherein the conveyer-drawing members lie in plane with the central axis and are positioned at divergence angle α with respect to the central axis.

2. The method of claim 1, providing the drawing apparatus wherein a length of the conveyer-drawing structure is about 500 mm to about 6000 mm.

3. The method of claim 1, providing the drawing apparatus wherein a number of the fiber loops being drawn in the apparatus is about 50 to about 600.

4. The method of claim 1, providing the drawing apparatus wherein a circumference of the leading fiber loop at the delivery ends is about 2000 mm to about 5500 mm.

5. The method of claim 1, providing the drawing apparatus wherein a draw ratio is about 2.3× to about 7.7×.

6. The method of claim 1, providing the drawing apparatus wherein outlet speed $V_{outlet}$ is about 500 m/min to about 6000 m/min.

7. The method of claim 1, providing the drawing apparatus wherein the ratio of fiber outlet speed $V_{outlet}$ to fiber speed $(V_{fiber})_{max}$ is about 250 to 1 to about 9,000 to 1.

8. The method of claim 1, providing the fiber drawing apparatus further comprising:

(a) a fiber feed means comprising a fiber-winding flyer rotating about the central axis and laying continuously the incoming fiber into coiled loops on the receiving ends of the conveyer-drawing members and (b) a fiber take-off means comprising a fiber-unwinding flyer rotating about the central axis, unwinding and taking off continuously the leading fiber loops at the delivery ends.

9. The method of claim 1, providing the conveyer-drawing members, which are selected from the group consisting of circulating endless chains, cables, belts, bands, cords, and escalator-type moving stairs, wherein the conveyer-drawing members further comprise a plurality of fiber-displacing members supporting the fiber loops, preventing the fiber loops from sliding down along the conveyer-drawing members at any angle of their divergency, and facilitating the conveying, simultaneous drawing the fiber loops at predetermined draw temperature, and, in case of the fiber breakage, conveying the broken fiber ends to the delivery ends where an operator can handle them.

10. The method of claim 9, providing the fiber-displacing members, which are rollers with circular grooves, wherein the fiber is placed in the grooves of the rollers so that the rollers support the coiled fiber loops.

11. The method of claim 10, providing the rollers, which are driven about their axes, the coiled fiber loops being rotated about the central axis by the rotating rollers, contact points between the fiber and the rollers being not permanent.

12. The method of claim 9, providing the fiber-displacing members, which are selected from the group consisting of semi-rings, plates, rods, and pins.

13. The method of claim 1, providing the conveyer-drawing members, which are rotating spindles having fiber-displacing members selected from the group consisting of threads and spiral grooves, wherein the rotating spindles rotate the coiled fiber loops about the central axis, contact points between the fiber and the spindles being not permanent.

14. The method of claim 1, providing the fiber drawing apparatus comprising:

(a) two conveyer-drawing members, which are selected from the group consisting of circulating endless chains, cables, belts, bands, cords, and escalator-type moving stairs, wherein the conveyer-drawing members further comprise a plurality of fiber-displacing members supporting the fiber loops, preventing the fiber loops from sliding down along the conveyer-drawing members at any angle of their divergency, and facilitating the conveying and simultaneous drawing the fiber loops at predetermined draw temperature, and wherein the fiber-displacing members are selected from the group consisting of rollers, semi-rings, plate, rods, and pins, (b) a feed means, which comprises a feed flyer reciprocating in the direction perpendicular to the central axis laying continuously the incoming fiber into successive coiled serpentine loops on the receiving ends of the conveyer-drawing members, and (c) a take-off means, which comprises a take-off flyer reciprocating in the direction perpendicular to the central axis taking off continuously the leading fiber loops at the delivery ends.

15. The method of claim 14, providing (a) the feed means, which is constructed and arranged to lay continuously the incoming parallel multiple fiber ends into successive coiled serpentine loops on the receiving ends of the conveyer-drawing members, parallel multiple layers comprising the fiber loops being formed on the conveyer-drawing members, wherein each layer being formed by one fiber end, and wherein the multiple fiber ends are conveyed along the central axis and simultaneously drawn by the conveyer-drawing members, and (b) the take-off means, which is constructed and arranged to take off continuously the multiple leading fiber loops at the delivery ends.

16. The method of claim 1, providing the conveyer-drawing members, which are selected from the group consisting of circulating endless chains, cables, belts, bands, cords, and escalator-type moving stairs, wherein the conveyer-drawing members further comprise a plurality of fiber-displacing members sup the fiber loops, preventing the fiber loops from sliding down, along the conveyer-drawing members at any angle of their divergency, and facilitating the conveying and simultaneous drawing the fiber loops at predetermined draw temperature, wherein the fiber-displacing members are selected from the group consisting of rollers, semi-rings, plates, rods, and pins, and wherein the conveyer-drawing structure rotates about the central axis and this rotation promotes wining the incoming fiber continuously into successive coiled loops on the receiving ends of the conveyer-drawing members and unwinding and taking off continuously the leading fiber loops from the delivery ends of the conveyer-drawing members.

17. The method of claim 1, providing the drawing apparatus, which further comprises a means for adjusting the fiber draw ratio, the means being selected from the group consisting of (a) a means for adjusting the distance between the receiving ends and the central axis, (b) a means for changing a position along the central axis where the fiber is received on the conveyor-drawing member, (c) a means for adjusting the distance between the delivery ends and the central axis, and (d) a means for changing a position along the central axis where the fiber is taken off from the conveyer-drawing members.

18. The method of claim 1, providing a heat chamber for heating the fiber while the fiber being conveyed and drawn, wherein the heat chamber is supplied with a heat medium selected from the group consisting of hot air, hot inert gas, and superheated steam.

19. The method of claim 1, providing a heater for heating the fiber while the fiber being conveyed and drawn, wherein the heater is selected from the group consisting of hot plates and baths of an active media.

20. An apparatus for continuously drawing fibers comprising a conveyer-drawing structure comprising at least two conveyer-drawing members for conveying and simultaneous drawing of the fiber, wherein the conveyer-drawing members are disposed about a central axis, which is parallel to a direction of conveying, and have receiving ends for receiving the fiber and delivery ends for delivering the fiber, and both the receiving and delivery ends are spaced along the central axis, wherein the delivery ends are spaced further from the central axis than the receiving ends, wherein the drawing apparatus is constructed and arranged for feeding the fiber to the drawing apparatus, laying the fiber continuously into coiled loops on the receiving ends of the conveyer-drawing members, taking off continuously the leading fiber loops from the delivery ends of the conveyer-drawing members, and conveying the fiber from the drawing apparatus at an outlet speed $V_{outlet}$, wherein the conveyer-drawing members draw the fiber in the form of the coiled loops at a draw temperature and speed by expanding a circumference of the fiber loops while conveying the fiber loops along the central axis from the receiving ends to the delivery ends, a layer comprising the coiled fiber loops being formed on the conveyer-drawing members, wherein the fiber drawing apparatus is constructed and arranged to provide a ratio of fiber outlet speed $V_{outlet}$ to a fiber speed $(V_{fiber})_{max}$ greater than 1 to 1, fiber speed $(V_{fiber})_{max}$ being the highest value of a linear speed of fiber points along the fiber axis in the process of drawing, wherein the conveyer-drawing members have both the receiving and delivery ends supported, wherein the conveyer-drawing members lie in plane with the central axis and are positioned at divergence angle $\alpha$ with respect to the central axis.

21. The drawing apparatus of claim 20 wherein a length of the conveyer-drawing structure is about 500 mm to about 6000 mm.

22. The drawing apparatus of claim 20 wherein a number of the fiber loops being drawn in the apparatus is about 50 to about 600.

23. The drawing apparatus of claim 20 wherein a circumference of the leading fiber loop at the delivery ends is about 2000 mm to about 5500 mm.

24. The drawing apparatus of claim 20 wherein a draw ratio is about 2.3× to about 7.7×.

25. The drawing apparatus of claim 20 wherein outlet speed $V_{outlet}$ is about 500 m/min to about 6000 m/min.

26. The drawing apparatus of claim 20 wherein the ratio of fiber outlet speed $V_{outlet}$ to fiber speed $(V_{fiber})_{max}$ is about 250 to 1 to about 9,000 to 1.

27. The apparatus of claim 20 further comprising:

(a) a feed means comprising a fiber-winding flyer rotting about the central axis and laying continuously the incoming fiber into coiled loops on the receiving ends of the conveyer-drawing members, and (b) a take-off means comprising a fiber-unwinding flyer rotating about the central axis, unwinding and taking off continuously the leading fiber loops at the delivery ends of the conveyer-drawing members.

28. The apparatus of claim 20 wherein the conveyer-drawing members are selected from the group consisting of circulating endless chains, cables, belts, cords, and escalator-type moving stairs, wherein the conveyer-drawing members further comprise a plurality of fiber-displacing members supporting the fiber loops, preventing the fiber loops from sliding down along the conveyer-drawing members at any angle of their divergency, and facilitating the conveying, simultaneous drawing the fiber loops at predetermined draw temperature, and, in case of the fiber breakage, conveying the broken fiber ends to the delivery ends where an operator can handle them.

29. The apparatus of claim 28 wherein the fiber-displacing members are rollers with circular grooves, wherein the fiber is placed in the grooves of the rollers so that the rollers support the coiled fiber loops.

30. The apparatus of claim 29 wherein the rollers are driven about their axes, the coiled fiber loops being rotated about the central axis by the rotating rollers, contact points between the fiber and the rollers being not permanent.

31. The apparatus of claim 28 wherein the fiber-displacing members are selected from the group consisting of semi-rings, plates, rods, and pins.

32. The apparatus of claim 20 wherein the conveyer-drawing members are rotating spindles having fiber-displacing members selected from the group consisting of threads and spiral grooves, wherein the rotating spindles rotate the coiled fiber loops about the central axis, contact points between the fiber and the spindles being not permanent.

33. The apparatus of claim 20 wherein the drawing apparatus comprises:

(a) two conveyer-drawing members, which are selected from the group consisting of circulating endless chains, cables, belts, bands, cords, and escalator-type moving stairs, wherein the conveyer-drawing members further comprise a plurality of fiber-displacing members supporting the fiber loops, preventing the fiber loops from sliding down along the conveyer-drawing members at any angle of their divergency, and facilitating the conveying and simultaneous drawing the fiber loops at predetermined draw temperature, and wherein the fiber-displacing members are selected from the group consisting of rollers, semi-rings, plates, rods, and pins, (b) a feed means, which comprises a feed flyer reciprocating in the direction perpendicular to the central axis laying continuously the incoming fiber into successive coiled serpentine loops on the receiving ends of the conveyer-drawing members, and (c) a take-off means, which comprises a take-off flyer reciprocating in the direction perpendicular to the central axis taking off continuously the leading fiber loops at the delivery ends.

34. The apparatus of claim 33 wherein:

(a) the feed means is constructed and arranged to lay continuously the incoming parallel multiple fiber ends into successive coiled serpentine loops on the receiving ends of the conveyer-drawing members, parallel multiple layers comprising the fiber loops being formed on the conveyer-drawing members, wherein each layer being formed by one fiber end, and wherein the multiple fiber ends are conveyed along the central axis and simultaneously drawn by the conveyer-drawing members, and (b) the take-off means, which is constructed and arranged to take off continuously the multiple leading fiber loops at the delivery ends.

35. The apparatus of claim 20 wherein the conveyer-drawing members are selected from the group consisting of circulating endless chains, cables, belts, bands, cords, and escalator-type moving stairs, wherein the conveyer-drawing members further comprise a plurality of fiber-displacing members supporting the fiber loops, preventing the fiber loops from sliding down along the conveyer-drawing members at any angle of their divergency, and facilitating the conveying and simultaneous drawing the fiber loops at predetermined draw temperature, wherein the fiber-displacing members are selected from the group consisting of rollers, semi-rings, plates, rods, and pins, and wherein the conveyer-drawing structure rotates about the central axis and this rotation promotes winding the incoming fiber continuously into successive coiled loops on the receiving ends of the conveyer-drawing members and unwinding and taking off continuously the leading fiber loops from the delivery ends of the conveyer-drawing members.

36. The drawing apparatus of claim 20, which further comprises a means for adjusting the fiber draw ratio selected from the group consisting of (a) a means for adjusting the distance between the receiving ends and the central axis, (b) a means for changing a position along the central axis where the fiber is received on the conveyer-drawing members, (c) a means for adjusting the distance between the delivery ends and the central axis, and (d) a means for changing a position along the central axis where the fiber is taken off from the conveyer-drawing members.

37. The apparatus of claim 20, which further comprises a heat chamber for heating the fiber while it being conveyed and drawn, wherein the heat chamber is supplied with a heat medium selected from the group consisting of hot air, hot inert gas, and superheated steam.

38. The apparatus of claim 20, which further comprises a heater for heating the fiber while it is being conveyed and drawn, wherein the heater is selected from the group consisting of hot plates and baths of an active media.

* * * * *

UNITED STATES PATENT AND TRADEMARK OFFICE

CERTIFICATE OF CORRECTION

PATENT NO. : 7,273,578 B1
APPLICATION NO. : 11/155810
DATED : September 25, 2007
INVENTOR(S) : Slutsker et al.

It is certified that error appears in the above-identified patent and that said Letters Patent is hereby corrected as shown below:

The title page, item 76 part 'Inventors', change "Tikaoretskii" to --Tikhoretskii--.

Col. 20, equation (16), change "$(V_{fiber}) = d \cdot tg\ \alpha \cdot cos[90 \cdot (1\text{-}2/n)] \sim 1/\Delta T$" to --$(V_{fiber})_{max} = d \cdot tg\ \alpha \cdot cos[90 \cdot (1\text{-}2/n)] \cdot 1/\Delta T$--.

Col. 19, line 6, after "$(V_{fiber})_{max}$" insert --in--.

Col. 3, lines 33 and 34, change ""low-oriented-high-oriented polymer system"" to --"low-oriented -- high-oriented polymer system"--.

Col. 11, line 22, change "$\gamma$" to --$\alpha$--.

Col. 20, equation (14), change "$(V_{fiber})_{max} = PW \cdot cos[90 \cdot (1\text{-}2/n)]1/\Delta T$" to --$(V_{fiber})_{max} = PW \cdot cos[90 \cdot (1\text{-}2/n)] \cdot 1/\Delta T$--.

Col. 20, equation(19), change "$B = V_{outlet}/(V_{fiber})_{max} = L/\{d \sim tg\ \alpha \cdot cos[90 \cdot (1\text{-}2/n)]\}$" to --$B = V_{outlet}/(V_{fiber})_{max} = L/\{d \cdot tg\ \alpha \cdot cos[90 \cdot (1\text{-}2/n)]\}$--.

Col. 26, below TABLE IV, change "$T_3$ - time if cooling drawn fiber …." to --$T_3$ - time of cooling drawn fiber ….--.

Col. 27, TABLE VI, delete "(Herculon, Marvess)".

Col. 27, line 57, change "1.54" to --1.5-4--.

Col. 35, line 45, change "sup" to --supporting--.

Col. 21, line 19, change "in a view" to --in view--.

Col. 4, line 19, change "U.S. Pat. Nos. 3,978,192 (1976)" to

--U.S. Pat. No. 3,978,192 (1976)--.

UNITED STATES PATENT AND TRADEMARK OFFICE

CERTIFICATE OF CORRECTION

PATENT NO. : 7,273,578 B1
APPLICATION NO. : 11/155810
DATED : September 25, 2007
INVENTOR(S) : Slutsker et al.

It is certified that error appears in the above-identified patent and that said Letters Patent is hereby corrected as shown below:

Col. 19, line 4, change the title "Calculations" to --CALCULATIONS-- and provide double line spacing below it.

Col. 19, lines 45 and 46, change the title "(a) The Case of the Embodiments of FIGS. 1A-4A with the Coiled Equilateral Polygonal Fiber Loops." to --(a) *The case of the embodiments of FIGS. 1A-4A with the coiled equilateral polygonal fiber loops*.-- and provided double line spacing below it.

Col. 22, lines 15 and 16, change title "(b) The Case of the Embodiment of FIG. 5A with the Coiled Serpentine Fiber Loops." to --(b) *The case of the embodiment of FIG. 5A with the coiled serpentine fiber loops*.-- and provide double line spacing under it.

Col. 22, lines 32 and 33, provide double line spacing between line 32 "….draw multiple ends." and line 33 "Thus, in the cases examined in Examples 1-3….".

Col. 25, lines 22 and 23, provide double line spacing between line 22 "EXPERIMENT -- Drawing of Polypropylene Fibers." and line 23 "The first version of a prototype of the drawing apparatus….".

Col. 26, line 32, change "shinkage" to --shrinkage--.

Col. 35, line 55, change "wining" to --winding--.

Col. 29, lines 50 and 51, change "last paragraph of page 35" to --column 22 (lines 50 and 51)--.

Col. 30, line 2, change "(pages 26-29" to --(column 17, line 8 and column 18, line 23)--.

Col. 30, line 8, change "(pages 25, last paragraph)" to --(column 16, lines 42 to 62)--.

Col. 2, line 37, after "$V_{fiber2}$" delete comma.

UNITED STATES PATENT AND TRADEMARK OFFICE

CERTIFICATE OF CORRECTION

PATENT NO. : 7,273,578 B1
APPLICATION NO. : 11/155810
DATED : September 25, 2007
INVENTOR(S) : Slutsker et al.

It is certified that error appears in the above-identified patent and that said Letters Patent is hereby corrected as shown below:

Col. 6, lines 37 and 40 change "circular" to --polygonal--.

Col. 16, line 19, change "FIG. 3" to --FIG. 3A--.

Col. 25, line 29, change "successively" to --successfully--.

Col. 31, lines 55 and 56, change "right hand thread …..left hand thread" to --right-hand thread …..left-hand thread--.

Col. 7, lines 10 and 11, change -"low oriented - high oriented polymer system transition"- to --"low-oriented -- high-oriented polymer system transition"--.

Col. 21, line 43 (below equation (34)), after "$V_{outlet}$ is" insert --directly--.

Col. 26, Table IV, dimension for $T_3$, change "s sec" to --sec--.

Col. 27, below Table V, definition of $T_6$, after "at rest" insert --and--.

Col. 31, lines 9 and 10, after "e.g.," delete --the threaded spindles or--.

Col. 33, designation of $L_{total}$, change "by the rotating spindles or rollers" to --(by the rotating spindles or rollers)--.

UNITED STATES PATENT AND TRADEMARK OFFICE

CERTIFICATE OF CORRECTION

PATENT NO. : 7,273,578 B1
APPLICATION NO. : 11/155810
DATED : September 25, 2007
INVENTOR(S) : Slutsker et al.

It is certified that error appears in the above-identified patent and that said Letters Patent is hereby corrected as shown below:

Col. 33, designation of $V_{rotation}$, change "by the rotating rollers or spindles" to --(by the rotating rollers or spindles)--.

Signed and Sealed this

Third Day of June, 2008

JON W. DUDAS
*Director of the United States Patent and Trademark Office*